US006486121B2

(12) United States Patent
Wahl et al.

(10) Patent No.: US 6,486,121 B2
(45) **Date of Patent: *Nov. 26, 2002**

(54) SOFTENER ACTIVE DERIVED FROM ACYLATED TRIETHANOLAMINE

(75) Inventors: Errol Hoffman Wahl, Cincinnati, OH (US); Toan Trinh, Maineville, OH (US); Eugene Robert Carr, Peoria, IL (US); James J. MacDonald, Hernando, FL (US); Zaiyou Liu, West Chester, OH (US); Alex Haejoon Chung, West Chester, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,135

(22) PCT Filed: Apr. 15, 1998

(86) PCT No.: PCT/US98/07986

§ 371 (c)(1),
(2), (4) Date: Nov. 18, 1999

(87) PCT Pub. No.: WO98/47991

PCT Pub. Date: Oct. 29, 1998

(65) Prior Publication Data

US 2001/0004635 A1 Jun. 21, 2001

(51) Int. Cl.[7] ..... C11D 1/62; C11D 1/835
(52) U.S. Cl. ..... 510/527; 510/504; 510/522
(58) Field of Search ..... 510/504, 515, 510/522, 527

(56) References Cited

U.S. PATENT DOCUMENTS

| | | | | |
|---|---|---|---|---|
| 3,915,867 A | | 10/1975 | Kang et al. | 252/8.8 |
| 5,296,622 A | * | 3/1994 | Uphues et al. | 554/103 |
| 5,437,801 A | * | 8/1995 | Lueders et al. | 252/8.8 |
| 5,747,443 A | * | 5/1998 | Wahl et al. | 510/515 |

FOREIGN PATENT DOCUMENTS

| | | | |
|---|---|---|---|
| EP | 0 370 675 A2 | | 5/1990 |
| EP | 0 498 050 A2 | | 8/1992 |
| EP | 0 498 050 A3 | | 8/1992 |
| WO | WO 91/17974 | | 11/1991 |
| WO | WO 93/21291 | | 10/1993 |
| WO | 97/03169 | * | 1/1997 |
| WO | WO 97/34972 | | 9/1997 |

* cited by examiner

*Primary Examiner*—John Hardee
(74) *Attorney, Agent, or Firm*—Jason J. Camp; Kim William Zerby; Steven W. Miller

(57) ABSTRACT

Fabric softener compounds having the formula: $[RC(O)]_nN^+(R^1)_mX^-$ wherein each R in a compound is a $C_6$–$C_{22}$ hydrocarbyl group, preferably having an IV from about 70 to about 140 based upon the IV of the equivalent fatty acid, n is a number from 1 to three on the weight average in any mixture of compounds, each $R^1$ in a compound is a $C_{1-3}$ alkyl or hydroxy alkyl group, the total of n and the number of $R^1$ groups that are hydroxyethyl groups equaling 3, n+m=4 and X is a softener compatible anion, preferably methyl sulfate, the compound, or mixtures of such compounds, having (a) either a Hunter "L" transmission of at least about 85, typically from about 85 to about 95, preferably from about 90 to about 95, more preferably above about 95, if possible, (b) only non-detectable levels, at the conditions of use, of odorous compounds selected from the group consisting of: isopropyl acetate, which should be, less than about 5, preferably less than about 3, and more preferably less than about 2, ηg/L.; 2,2'-ethylidenebis(oxy) bispropane, which should be less than about 200, preferably less than about 100, more preferably less than about 10, and even more preferably less than about 5, ηg/L.; 1,3,5-trioxane, which should be less than about 50, preferably less than about 20, more preferably less than about 10, and even more preferably less than about 7, ηg/L.; and/or each short chain fatty acid (4–12, especially 6–10, carbon atoms) ester, especially methyl esters, which should be less than about 4, preferably less than about 3, and more preferably less than about 2, ηg/L. or (c) preferably, both. The fabric softener actives are preferably prepared in the presence of chelating agent and/or antioxidant, as disclosed herein. Such materials are new. Solvents can be present.

26 Claims, No Drawings

SOFTENER ACTIVE DERIVED FROM ACYLATED TRIETHANOLAMINE

TECHNICAL FIELD

The present invention relates to specific fabric softener actives that are suitable for preparation of concentrated fabric softening compositions. Specifically, acylated derivatives of triethanolamine are provided that solve problems that have previously gone unnoticed, particularly for clear, or translucent liquid compositions.

BACKGROUND OF THE INVENTION

Concentrated clear compositions containing ester and/or amide linked fabric softening actives are disclosed in co-pending application Ser. No. 08/679,694, filed Jul. 11, 1996 in the names of E. H. Wahl, T. Trinh, E. P. Gosselink, J. C. Letton, and M. R. Sivik, for Fabric Softening Compound/Composition, said application being incorporated herein by reference. The fabric softener actives in said applications are all biodegradable ester-linked materials, containing, long hydrophobic groups unsaturated chains. Concentrated compositions in the form of dispersions are also contemplated.

SUMMARY OF THE INVENTION

The essential fabric softening compounds herein are those having the formula:

$$[RC(O)OC_2H_4]_nN^+(R^1)_mX^-$$

wherein each R in a compound is a $C_6$–$C_{22}$, preferably with only minimal, or no, $C_{6-10}$, hydrocarbyl group, preferably having an Iodine Value (hereinafter also referred to as IV) of from about 70 to about 140 based upon the IV of the equivalent fatty acid, n is a number from 1 to three on the weight average in any mixture of compounds, each $R^1$ in a compound is a $C_{1-3}$ alkyl or hydroxy alkyl group, the total of n and the number of $R^1$ groups that are hydroxyethyl groups equaling 3, n+m equaling 4, and X is a softener compatible anion, preferably methyl sulfate. Preferably the cis:trans isomer ratio of the fatty acid (of the C18:1 component) is at least about 1:1, preferably about 2:1, more preferably 3:1, and even more preferably about 4:1, or higher.

The compound, or mixtures of compounds, have (a) either a Hunter "L" transmission of at least about 85, typically from about 85 to about 95, preferably from about 90 to about 95, more preferably above about 95, if possible; (b) only very low, e.g., non-detectable levels, at the conditions of use, of odorous compounds selected from the group consisting of: isopropyl acetate; 2,2'-ethylidenebis(oxy)bispropane; 1,3,5-trioxane; and/or short chain fatty acid (4–12, especially 6–10, carbon atoms) esters, especially methyl esters; or (c) preferably, both.

The above compounds are suitable for use in concentrated fabric conditioning compositions, especially in clear, concentrated compositions. The compounds provide improved compositions containing:

A. from about 2% to about 75%, preferably from about 8% to about 70%, more preferably from about 13% to about 65%, and even more preferably, from about 18% to about 40%, of said compound, or mixtures of such compounds; and B. less than about 40% by weight of the composition of principal solvent having a ClogP of from about 0.15 to about 0.64, and at least some degree of asymmetry.

Also, the compositions can be aqueous, stable fabric softener dispersion compositions containing: from about 5% to about 35%, preferably from about 8% to about 30%, more preferably from about 10% to about 28%, and even more preferably from about 13% to about 26%, by weight of the composition, of said cationic fabric softener compound.

For the clear compositions, the solvent is typically less than about 40%, preferably from about 5% to about 35%, more preferably from about 10% to about 25%, and even more preferably from about 12% to about 18%, by weight of the composition, especially of principal solvent having a ClogP of from about 0.15 to about 0.64, preferably from about 0.25 to about 0.62, and more preferably from about 0.40 to about 0.60. Said solvent is typically the principal solvent. When there is an insufficient amount of principal solvent e.g.: 2,2,4-trimethyl-1,3-pentanediol; the ethoxylate, diethoxylate, or triethoxylate derivatives of 2,2,4-trimethyl-1,3-pentanediol; 2-ethyl-1,3-hexanediol; and/or 2-ethyl-1,3-hexanediol ethoxylates (1–3) and/or mixtures thereof, to provide a clear product, or even to provide a stable product, other solvents can be added, preferably 1,4-cyclohexanedimethanol.

The typical principal solvent is preferably selected from the group consisting of:

I. mono-ols including:
   a. n-propanol; and/or
   b. 2-butanol and/or 2-methyl-2-propanol;

II. hexane diol isomers including: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and/or 1,2-hexanediol;

III. heptane diol isomers including: 1,3-propanediol, 2-butyl-; 1,3-propanediol, 2,2-diethyl-; 1,3-propanediol, 2-(1-methylpropyl)-; 1,3-propanediol, 2-(2-methylpropyl)-; 1,3-propanediol, 2-methyl-2-propyl-; 1,2-butanediol, 2,3,3-trimethyl-; 1,4-butanediol, 2-ethyl-2-methyl-; 1,4-butanediol, 2-ethyl-3-methyl-; 1,4-butanediol, 2-propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-; 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; and/or 1,6-heptanediol;

IV. octane diol isomers including: 1,3-propanediol, 2-(2-methylbutyl)-; 1,3-propanediol, 2-(1,1-dimethylpropyl)-1,3-propanediol, 2-(1,2-dimethylpropyl)-; 1,3-propanediol, 2-(1-ethylpropyl)-; 1,3-propanediol, 2-(1-methylbutyl)-; 1,3-propanediol, 2-(2,2-dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2-isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 1,6-hexanediol, 2,2-dimethyl-; 1,6-hexanediol, 2,3-dimethyl-; 1,6-hexanediol, 2,4-dimethyl-; 1,6-hexanediol, 2,5-dimethyl-; 1,6-hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-; 2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; and/or 3,6-octanediol;

V. nonane diol isomers including: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; and/or 2,5-hexanediol, 3,3,5-trimethyl-;

VI. glyceryl ethers and/or di(hydroxyalkyl)ethers including: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, triethoxylated; 1,2-propanediol, 3-(butyloxy)-, tetraethoxylated; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; 1,2-propanediol, 3-(butyloxy)-, tributyleneoxylated; 1,2-propanediol, 3-phenyloxy-; 1,2-propanediol, 3-benzyloxy-; 1,2-propanediol, 3-(2-phenylethyloxy)-; 1,2-propanediol, 3-(1-phenyl-2-propanyloxy)-; 1,3-propanediol, 2-phenyloxy-; 1,3-propanediol, 2-(m-cresyloxy)-; 1,3-propanediol, 2-(p-cresyloxy)-; 1,3-propanediol, -benzyloxy-; 1,3-propanediol, 2-(2-phenylethyloxy)-; 1,3-propanediol, 2-(1-phenylethyloxy)-; bis(2-hydroxybutyl)ether; and/or bis(2-hydroxycyclopentyl) ether;

VII. saturated and unsaturated alicyclic diols and their derivatives including:

(a) the saturated diols and their derivatives, including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl) cyclohexane; 1,2-bis(hydroxymethyl)cyclohexane; 1,2-dimethyl-1,3-cyclohexanediol; 1,3-bis (hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; ; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate; and (b). the unsaturated alicyclic diols including: 1,2-cyclobutanediol, 1-ethenyl-2-ethyl-; 3-cyclobutene-1,2-diol, 1,2,3,4-tetramethyl-; 3-cyclobutene-1,2-diol, 3,4-diethyl-; 3-cyclobutene-1,2-diol, 3-(1,1-dimethylethyl)-; 3-cyclobutene-1,2-diol, 3-butyl-; 1,2-cyclopentanediol, 1,2-dimethyl-4-methylene-; 1,2-cyclopentanediol, 1-ethyl-3-methylene-; 1,2-cyclopentanediol, 4-(1-propenyl); 3-cyclopentene-1,2-diol, 1-ethyl-3-methyl-; 1,2-cyclohexanediol, 1-ethenyl-; 1,2-cyclohexanediol, 1-methyl-3-methylene-; 1,2-cyclohexanediol, 1-methyl-4-methylene-; 1,2-cyclohexanediol, 3-ethenyl-; 1,2-cyclohexanediol, 4-ethenyl-; 3-cyclohexene-1,2-diol, 2,6-dimethyl-; 3-cyclohexene-1,2-diol, 6,6-dimethyl-; 4-cyclohexene-1,2-diol, 3,6-dimethyl-; 4-cyclohexene-1,2-diol, 4,5-dimethyl-; 3-cyclooctene-1,2-diol; 4-cyclooctene-1,2-diol; and/or 5-cyclooctene-1,2-diol;

VIII. Alkoxylated derivatives of $C_{3-8}$ diols [In the following disclosure, "EO" means polyethoxylates, i.e., —$(CH_2CH_2O)_nH$; Me-$E_n$ means methyl-capped polyethoxylates —$(CH_2CH_2O)_nCH_3$; "2(Me-En)" means 2 Me-En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly(n-butyleneoxy) or poly(tetramethylene)oxy groups —$(CH_2CH_2CH_2CH_2O)_nH$. The use of the term "$(C_x)$" herein refers to the number of carbon atoms in the base material which is alkoxylated.] including:

1. 1,2-propanediol 2(Me-$E_{1-4}$); 1,2-propanediol $PO_4$; 1,2-propanediol, 2-methyl-(Me-$E_{4-10}$); 1,2-propanediol, 2-methyl-2(Me-$E_1$); 1,2-propanediol, 2-methyl-$PO_3$; 1,2-propanediol, 2-methyl-$BO_1$; 1,3-propanediol 2(Me-$E_{6-8}$); 1,3-propanediol $PO_{5-6}$; 1,3-propanediol, 2,2-diethyl-$E_{1-7}$; 1,3-propanediol, 2,2-diethyl-$PO_1$; 1,3-propanediol, 2,2-diethyl-n-$BO_{1-2}$; 1,3-propanediol, 2,2-dimethyl-2(Me $E_{1-2}$); 1,3-propanediol, 2,2-dimethyl-$PO_{3-4}$; 1,3-propanediol, 2-(1-methylpropyl)-$E_{1-7}$; 1,3-propanediol, 2-(1-methylpropyl)-$PO_1$; 1,3-propanediol, 2-(1-methylpropyl)-n-$BO_{1-2}$; 1,3-propanediol, 2-(2-methylpropyl)-$E_{1-7}$; 1,3-propanediol, 2-(2-methylpropyl)-$PO_1$; 1,3-propanediol, 2-(2-methylpropyl)-n-$BO_{1-2}$; 1,3-propanediol, 2-ethyl-(Me $E_{6-10}$); 1,3-propanediol, 2-ethyl-2(Me $E_1$); 1,3-propanediol, 2-ethyl-$PO_3$; 1,3-propanediol, 2-ethyl-2-methyl-(Me $E_{1-6}$); 1,3-propanediol, 2-ethyl-2-methyl-$PO_2$; 1,3-propanediol, 2-ethyl-2-methyl-$BO_1$; 1,3-propanediol, 2-isopropyl-(Me $E_{1-6}$); 1,3-propanediol, 2-isopropyl-$PO_2$; 1,3-propanediol, 2-isopropyl-$BO_1$; 1,3-propanediol, 2-methyl-2(Me $E_{2-5}$); 1,3-propanediol, 2-methyl-$PO_{4-5}$; 1,3-propanediol, 2-methyl-$BO_2$; 1,3-propanediol, 2-methyl-2-isopropyl-$E_{2-9}$; 1,3-propanediol, 2-methyl-2-isopropyl-$PO_1$; 1,3-propanediol, 2-methyl-2-isopropyl-n-$BO_{1-3}$; 1,3-propanediol, 2-methyl-2-propyl-$E_{1-7}$; 1,3-propanediol, 2-methyl-2-propyl-$PO_1$; 1,3-propanediol, 2-methyl-2-propyl-n-$BO_{1-2}$; 1,3-propanediol, 2-propyl-(Me $E_{1-4}$); 1,3-propanediol, 2-propyl-$PO_2$; 1,3-propanediol, 2-propyl-$BO_1$;

2. 1,2-butanediol (Me $E_{2-8}$); 1,2-butanediol $PO_{2-3}$; 1,2-butanediol $BO_1$; 1,2-butanediol, 2,3-dimethyl-$E_{1-6}$; 1,2-butanediol, 2,3-dimethyl-n-$BO_{1-2}$; 1,2-butanediol, 2-ethyl-$E_{1-3}$; 1,2-butanediol, 2-ethyl-n-$BO_1$; 1,2-butanediol, 2-methyl-(Me $E_{1-2}$); 1,2-butanediol, 2-methyl-$PO_1$; 1,2-butanediol, 3,3-dimethyl-$E_{1-6}$; 1,2-butanediol, 3,3-dimethyl-n-$BO_{1-2}$; 1,2-butanediol, 3-methyl-(Me $E_{1-2}$); 1,2-butanediol, 3-methyl-$PO_1$; 1,3-butanediol 2(Me $E_{3-6}$); 1,3-butanediol $PO_5$; 1,3-butanediol $BO_2$; 1,3-butanediol, 2,2,3-trimethyl-(Me $E_{1-3}$); 1,3-butanediol, 2,2,3-trimethyl-$PO_{1-2}$; 1,3-butanediol, 2,2-dimethyl-(Me $E_{3-8}$); 1,3-butanediol, 2,2-dimethyl-$PO_3$; 1,3-butanediol, 2,3-dimethyl-(Me $E_{3-8}$); 1,3-butanediol, 2,3-dimethyl-$PO_3$; 1,3-butanediol, 2-ethyl-(Me $E_{1-6}$); 1,3-butanediol, 2-ethyl-$PO_{2-3}$; 1,3-butanediol, 2-ethyl-$BO_1$; 1,3-butanediol, 2-ethyl-2-methyl-(Me $E_1$); 1,3-butanediol, 2-ethyl-2-methyl-$PO_1$; 1,3-butanediol, 2-ethyl-2-methyl-n-$BO_{2-4}$; 1,3-butanediol, 2-ethyl-3-methyl-(Me $E_1$); 1,3-butanediol, 2-ethyl-3-methyl-$PO_1$; 1,3-butanediol, 2-ethyl-3-methyl-n-$BO_{2-4}$; 1,3-butanediol, 2-isopropyl-(Me $E_1$); 1,3-butanediol, 2-isopropyl-$PO_1$; 1,3-butanediol, 2-isopropyl-n-$BO_{2-4}$; 1,3-butanediol, 2-methyl-2(Me $E_{1-3}$); 1,3-butanediol, 2-methyl-$PO_4$; 1,3-butanediol, 2-propyl-$E_{2-9}$; 1,3-butanediol, 2-propyl-$PO_1$; 1,3-butanediol, 2-propyl-n-$BO_{1-3}$; 1,3-butanediol, 3-methyl-2(Me $E_{1-3}$); 1,3-butanediol, 3-methyl-$PO_4$; 1,4-butanediol 2(Me $E_{2-4}$); 1,4-butanediol $PO_{4-5}$; 1,4-butanediol $BO_2$; 1,4-butanediol, 2,2,3-trimethyl-$E_{2-9}$; 1,4-butanediol, 2,2,3-trimethyl-$PO_1$; 1,4-butanediol, 2,2,3-trimethyl-n-$BO_{1-3}$; 1,4-butanediol, 2,2-dimethyl-(Me $E_{1-6}$); 1,4-butanediol, 2,2-dimethyl-$PO_2$; 1,4-butanediol, 2,2-dimethyl-$BO_1$; 1,4-butanediol, 2,3-dimethyl-(Me $E_{1-6}$); 1,4-butanediol, 2,3-dimethyl-$PO_2$; 1,4-butanediol, 2,3-dimethyl-$BO_1$; 1,4-butanediol, 2-ethyl-(Me $E_{1-4}$); 1,4-butanediol, 2-ethyl-$PO_2$; 1,4-butanediol, 2-ethyl-$BO_1$; 1,4-butanediol, 2-ethyl-2-methyl-$E_{1-7}$; 1,4-butanediol, 2-ethyl-2-methyl-$PO_1$; 1,4-butanediol, 2-ethyl-2-methyl-n-$BO_{1-2}$; 1,4-butanediol, 2-ethyl-3-methyl-$E_{1-7}$; 1,4-butanediol, 2-ethyl-3-methyl-$PO_1$; 1,4-butanediol, 2-ethyl-3-methyl-n-$BO_{1-2}$; 1,4-butanediol, 2-isopropyl-$E_{1-7}$; 1,4-butanediol, 2-isopropyl-$PO_1$; 1,4-butanediol, 2-isopropyl-n-$BO_{1-2}$; 1,4-butanediol, 2-methyl-(Me $E_{6-10}$); 1,4-butanediol, 2-methyl-2(Me $E_1$); 1,4-butanediol, 2-methyl-$PO_3$; 1,4-butanediol, 2-methyl-$BO_1$; 1,4-butanediol, 2-propyl-$E_{1-5}$; 1,4-butanediol, 2-propyl-n-$BO_{1-2}$; 1,4-butanediol, 3-ethyl-1-methyl-$E_{2-9}$; 1,4-butanediol, 3-ethyl-1-methyl-$PO_1$; 1,4-butanediol, 3-ethyl-1-methyl-n-$BO_{1-3}$; 2,3-butanediol (Me $E_{6-10}$); 2,3-butanediol 2(Me $E_1$); 2,3-butanediol $PO_{3-4}$; 2,3-butanediol $BO_1$; 2,3-butanediol, 2,3-dimethyl-$E_{3-9}$; 2,3-butanediol, 2,3-dimethyl-$PO_1$; 2,3-butanediol, 2,3-dimethyl-n-$BO_{1-3}$; 2,3-butanediol, 2-methyl-(Me $E_{1-5}$); 2,3-butanediol, 2-methyl-$PO_2$; 2,3-butanediol, 2-methyl-$BO_1$;

3. 1,2-pentanediol $E_{3-10}$; 1,2-pentanediol, $PO_1$; 1,2-pentanediol, n-$BO_{2-3}$; 1,2-pentanediol, 2-methyl $E_{1-3}$; 1,2-pentanediol, 2-methyl n-$BO_1$; 1,2-pentanediol, 2-methyl $BO_1$; 1,2-pentanediol, 3-methyl $E_{1-3}$; 1,2-pentanediol, 3-methyl n-$BO_1$; 1,2-pentanediol, 4-methyl $E_{1-3}$; 1,2-pentanediol, 4-methyl n-$BO_1$; 1,3-pentanediol 2(Me-$E_{1-2}$); 1,3-pentanediol $PO_{3-4}$; 1,3-pentanediol, 2,2-dimethyl-(Me-$E_1$); 1,3-pentanediol, 2,2-dimethyl-$PO_1$; 1,3-pentanediol, 2,2-dimethyl-n-$BO_{2-4}$; 1,3-pentanediol, 2,3-dimethyl-(Me-$E_1$); 1,3-pentanediol, 2,3-dimethyl-$PO_1$; 1,3-pentanediol, 2,3-dimethyl-n-$BO_{2-4}$; 1,3-pentanediol, 2,4-dimethyl-(Me-$E_1$); 1,3-pentanediol, 2,4-dimethyl-$PO_1$; 1,3-pentanediol, 2,4-dimethyl-n-$BO_{2-4}$; 1,3-pentanediol, 2-ethyl-$E_{2-9}$; 1,3-pentanediol, 2-ethyl-$PO_1$; 1,3-pentanediol, 2-ethyl-n-$BO_{1-3}$; 1,3-pentanediol, 2-methyl-2(Me-$E_{1-6}$); 1,3-pentanediol, 2-methyl-$PO_{2-3}$; 1,3-pentanediol, 2-methyl-$BO_1$; 1,3-pentanediol, 3,4-dimethyl-(Me-$E_1$); 1,3-pentanediol, 3,4-dimethyl-$PO_1$; 1,3-pentanediol, 3,4-dimethyl-n-$BO_{2-4}$; 1,3-pentanediol, 3-methyl-(Me-$E_{1-6}$); 1,3-pentanediol, 3-methyl-$PO_{2-3}$; 1,3-pentanediol, 3-methyl-$BO_1$; 1,3-pentanediol, 4,4-dimethyl-(Me-$E_1$); 1,3-pentanediol, 4,4-dimethyl-$PO_1$; 1,3-pentanediol, 4,4-dimethyl-n-$BO_{2-4}$; 1,3-pentanediol, 4-methyl-(Me-$E_{1-6}$); 1,3-pentanediol, 4-methyl-$PO_{2-3}$; 1,3-pentanediol, 4-methyl-$BO_1$; 1,4-pentanediol, 2(Me-$E_{1-2}$); 1,4-pentanediol $PO_{3-4}$; 1,4-pentanediol, 2,2-dimethyl-(Me-$E_1$); 1,4-pentanediol, 2,2-dimethyl-$PO_1$; 1,4-pentanediol, 2,2-dimethyl-n-$BO_{2-4}$; 1,4-pentanediol, 2,3-dimethyl-(Me-$E_1$); 1,4-pentanediol, 2,3-dimethyl-$PO_1$; 1,4-pentanediol, 2,3-dimethyl-n-$BO_{2-4}$; 1,4-pentanediol, 2,4-dimethyl-(Me-$E_1$); 1,4-pentanediol, 2,4-dimethyl-$PO_1$; 1,4-pentanediol, 2,4-dimethyl-n-$BO_{2-4}$; 1,4-pentanediol, 2-methyl-(Me-$E_{1-6}$); 1,4-pentanediol, 2-methyl-$PO_{2-3}$; 1,4-pentanediol, 2-methyl-$BO_1$; 1,4-pentanediol, 3,3-dimethyl-(Me-$E_1$); 1,4-pentanediol, 3,3-dimethyl-$PO_1$; 1,4-pentanediol, 3,3-dimethyl-n-$BO_{2-4}$; 1,4-pentanediol, 3,4-dimethyl-(Me-$E_1$); 1,4-pentanediol, 3,4-dimethyl-$PO_1$; 1,4-pentanediol, 3,4-dimethyl-n-$BO_{2-4}$; 1,4-pentanediol, 3-methyl-2(Me-$E_{1-6}$); 1,4-pentanediol, 3-methyl-$PO_{2-3}$; 1,4-pentanediol, 3-methyl-$BO_1$; 1,4-pentanediol, 4-methyl-2(Me-$E_{1-6}$); 1,4-pentanediol, 4-methyl-$PO_{2-3}$; 1,4-pentanediol, 4-methyl-$BO_1$; 1,5-pentanediol, (Me-$E_{4-10}$); 1,5-pentanediol 2(Me-$E_1$); 1,5-pentanediol $PO_3$; 1,5-pentanediol, 2,2-dimethyl-$E_{1-7}$; 1,5-pentanediol, 2,2-dimethyl-$PO_1$; 1,5-pentanediol, 2,2-dimethyl-n-$BO_{1-2}$; 1,5-pentanediol, 2,3-dimethyl-$E_{1-7}$; 1,5-pentanediol, 2,3-dimethyl-$PO_1$; 1,5-pentanediol, 2,3-dimethyl-n-$BO_{1-2}$; 1,5-pentanediol, 2,4-dimethyl-$E_{1-7}$; 1,5-pentanediol, 2,4-dimethyl-$PO_1$; 1,5-pentanediol, 2,4-dimethyl-n-$BO_{1-2}$; 1,5-pentanediol, 2-ethyl-$E_{1-5}$; 1,5-pentanediol, 2-ethyl-n-$BO_{1-2}$; 1,5-pentanediol, 2-methyl-(Me-$E_{1-4}$); 1,5-pentanediol, 2-methyl-$PO_2$; 1,5-pentanediol, 3,3-dimethyl-$E_{1-7}$; 1,5-pentanediol, 3,3-dimethyl-$PO_1$; 1,5-pentanediol, 3,3-dimethyl-n-$BO_{1-2}$; 1,5-pentanediol, 3-methyl-(Me-$E_{1-4}$); 1,5-pentanediol, 3-methyl-$PO_2$; 2,3-pentanediol, (Me-$E_{1-3}$); 2,3-pentanediol, $PO_2$; 2,3-pentanediol, 2-methyl-$E_{1-7}$; 2,3-pentanediol, 2-methyl-$PO_1$; 2,3-pentanediol, 2-methyl-n-$BO_{1-2}$; 2,3-pentanediol, 3-methyl-$E_{1-7}$; 2,3-pentanediol, 3-methyl-$PO_1$; 2,3-pentanediol, 3-methyl-n-$BO_{1-2}$; 2,3-pentanediol, 4-methyl-$E_{1-7}$; 2,3-pentanediol, 4-methyl-$PO_1$; 2,3-pentanediol, 4-methyl-n-$BO_{1-2}$; 2,4-pentanediol, 2(Me-$E_{1-4}$); 2,4-pentanediol $PO_4$; 2,4-pentanediol, 2,3-dimethyl-(Me-$E_{1-4}$); 2,4-pentanediol, 2,3-dimethyl-$PO_2$; 2,4-pentanediol, 2,4-dimethyl-(Me-$E_{1-4}$); 2,4-pentanediol, 2,4-dimethyl-$PO_2$; 2,4-pentanediol, 2-methyl-(Me-$E_{5-10}$); 2,4-pentanediol, 2-methyl-$P_3$; 2,4-pentanediol, 3,3-dimethyl-(Me-$E_{1-4}$); 2,4-pentanediol, 3,3-dimethyl-$PO_2$; 2,4-pentanediol, 3-methyl-(Me-$E_{5-10}$); 2,4-pentanediol, 3-methyl-$PO_3$;

4. 1,3-hexanediol (Me-$E_{1-5}$); 1,3-hexanediol $PO_2$; 1,3-hexanediol $BO_1$; 1,3-hexanediol, 2-methyl-$E_{2-9}$; 1,3-hexanediol, 2-methyl-$PO_1$; 1,3-hexanediol, 2-methyl-n-$BO_{1-3}$; 1,3-hexanediol, 2-methyl-$BO_1$; 1,3-hexanediol, 3-methyl-$E_{2-9}$; 1,3-hexanediol, 3-methyl-$PO_1$; 1,3-hexanediol, 3-methyl-n-$BO_{1-3}$; 1,3-hexanediol, 4-methyl-$E_{2-9}$; 1,3-hexanediol, 4-methyl-$PO_1$; 1,3-hexanediol, 4-methyl-n-$BO_{1-3}$; 1,3-hexanediol, 5-methyl-$E_{2-9}$; 1,3-hexanediol, 5-methyl-$PO_1$; 1,3-hexanediol, 5-methyl-n-$BO_{1-3}$; 1,4-hexanediol (Me-$E_{1-5}$); 1,4-hexanediol $PO_2$; 1,4-hexanediol $BO_1$; 1,4-hexanediol, 2-methyl-$E_{2-9}$; 1,4-hexanediol, 2-methyl-$PO_1$; 1,4-hexanediol, 2-methyl-n-$BO_{1-3}$; 1,4-hexanediol, 3-methyl-$E_{2-9}$; 1,4-hexanediol, 3-methyl-$PO_1$; 1,4-hexanediol, 3-methyl-n-$BO_{1-3}$; 1,4-hexanediol, 4-methyl-$E_{2-9}$; 1,4-hexanediol, 4-methyl-$PO_1$; 1,4-hexanediol, 4-methyl-n-$BO_{1-3}$; 1,4-hexanediol, 5-methyl-$E_{2-9}$; 1,4-hexanediol, 5-methyl-$PO_1$; 1,4-hexanediol, 5-methyl-n-$BO_{1-3}$; 1,5-hexanediol (Me-$E_{1-5}$); 1,5-hexanediol $PO_2$; 1,5-hexanediol $BO_1$; 1,5-hexanediol, 2-methyl-$E_{2-9}$; 1,5-hexanediol, 2-methyl-$PO_1$; 1,5-hexanediol, 2-methyl-n-$BO_{1-3}$; 1,5-hexanediol, 3-methyl-$E_{2-9}$; 1,5-hexanediol, 3-methyl-$PO_1$; 1,5-hexanediol, 3-methyl-n-$BO_{1-3}$; 1,5-hexanediol, 4-methyl-$E_{2-9}$; 1,5-hexanediol, 4-methyl-$PO_1$; 1,5-hexanediol, 4-methyl-n-$BO_{1-3}$; 1,5-hexanediol, 5-methyl-$E_{2-9}$; 1,5-hexanediol, 5-methyl-$PO_1$; 1,5-hexanediol, 5-methyl-n-$BO_{1-3}$; 1,6-hexanediol (Me-$E_{1-2}$); 1,6-hexanediol $PO_{1-2}$; 1,6-hexanediol n-$BO_4$; 1,6-hexanediol, 2-methyl-$E_{1-5}$; 1,6-hexanediol, 2-methyl-n-$BO_{1-2}$; 1,6-hexanediol, 3-methyl-$E_{1-5}$; 1,6-hexanediol, 3-methyl-n-$BO_{1-2}$; 2,3-hexanediol $E_{1-5}$; 2,3-hexanediol n-$BO_1$; 2,3-hexanediol $BO_1$; 2,4-hexanediol (Me-$E_{3-8}$); 2,4-hexanediol $PO_3$; 2,4-hexanediol, 2-methyl-(Me-$E_{1-2}$); 2,4-hexanediol 2-methyl-$PO_{1-2}$; 2,4-hexanediol, 3-methyl-(Me-$E_{1-2}$); 2,4-hexanediol 3-methyl-$PO_{1-2}$; 2,4-hexanediol, 4-methyl-(Me-$E_{1-2}$); 2,4-hexanediol 4-methyl-$PO_{1-2}$; 2,4-hexanediol, 5-methyl-(Me-$E_{1-2}$); 2,4-hexanediol 5-methyl-$PO_{1-2}$; 2,5-hexanediol (Me-$E_{3-8}$); 2,5-hexanediol $P_3$; 2,5-hexanediol, 2-methyl-(Me-$E_{1-2}$); 2,5-hexanediol 2-methyl-$PO_{1-2}$; 2,5-hexanediol, 3-methyl-(Me-$E_{1-2}$); 2,5-hexanediol 3-methyl-$PO_{1-2}$; 3,4-hexanediol $EO_{1-5}$; 3,4-hexanediol n-$BO_1$; 3,4-hexanediol $BO_1$;

5. 1,3-heptanediol $E_{1-7}$; 1,3-heptanediol $PO_1$; 1,3-heptanediol n-$BO_{1-2}$; 1,4-heptanediol $E_{1-7}$; 1,4-heptanediol $PO_1$; 1,4-heptanediol n-$BO_{1-2}$; 1,5-heptanediol $E_{1-7}$; 1,5-heptanediol $PO_1$; 1,5-heptanediol n-$BO_{1-2}$; 1,6-heptanediol $E_{1-7}$; 1,6-heptanediol $PO_1$; 1,6-heptanediol n-$BO_{1-2}$; 1,7-heptanediol $E_{1-2}$; 1,7-heptanediol n-$BO_1$; 2,4-heptanediol $E_{3-10}$; 2,4-heptanediol (Me-$E_1$); 2,4-heptanediol $PO_1$; 2,4-heptanediol n-$BO_3$; 2,5-heptanediol $E_{3-10}$; 2,5-heptanediol (Me-$E_1$); 2,5-heptanediol $PO_1$; 2,5-heptanediol n-$BO_3$; 2,6-heptanediol $E_{3-10}$; 2,6-heptanediol (Me-$E_1$); 2,6-heptanediol $PO_1$; 2,6-heptanediol n-$BO_3$; 3,5-heptanediol $E_{3-10}$; 3,5-heptanediol (Me-$E_1$); 3,5-heptanediol $PO_1$; 3,5-heptanediol n-$BO_3$;

6. 1,3-butanediol, 3-methyl-2-isopropyl-$PO_1$; 2,4-pentanediol, 2,3,3-trimethyl-$PO_1$; 1,3-butanediol, 2,2-diethyl-$E_{2-5}$; 2,4-hexanediol, 2,3-dimethyl-$E_{2-5}$; 2,4-hexanediol, 2,4-dimethyl-$E_{2-5}$; 2,4-hexanediol, 2,5-dimethyl-$E_{2-5}$; 2,4-hexanediol, 3,3-dimethyl-$E_{2-5}$; 2,4-hexanediol, 3,4-dimethyl-$E_{2-5}$; 2,4-hexanediol, 3,5-dimethyl-$E_{2-5}$; 2,4-hexanediol, 4,5-dimethyl-$E_{2-5}$; 2,4-hexanediol, 5,5-dimethyl-$E_{2-5}$; 2,5-hexanediol, 2,3-dimethyl-$E_{2-5}$; 2,5-hexanediol, 2,4-dimethyl-$E_{2-5}$; 2,5-hexanediol, 2,5-dimethyl-$E_{2-5}$; 2,5-hexanediol, 3,3-dimethyl-$E_{2-5}$; 2,5-hexanediol, 3,4-dimethyl-$E_{2-5}$; 3,5-heptanediol, 3-methyl-$E_{2-5}$; 1,3-butanediol, 2,2-diethyl-n-$BO_{2-5}$; 2,4-hexanediol, 2,3-dimethyl-n-$BO_{1-2}$; 2,4-hexanediol, 2,4-dimethyl-n-$BO_{1-2}$; 2,4-hexanediol, 2,5-dimethyl-n-$BO_{1-2}$; 2,4-hexanediol, 3,3-dimethyl-n-$BO_{1-2}$; 2,4-hexanediol, 3,4-dimethyl-n-$BO_{1-2}$; 2,4-hexanediol, 3,5-dimethyl-n-$BO_{1-2}$; 2,4-hexanediol, 4,5-dimethyl-n-$BO_2$; 2,4-hexanediol, 5,5-dimethyl-, n-$BO_{1-2}$; 2,5-hexanediol, 2,3-dimethyl-n-$BO_{1-2}$; 2,5-hexanediol, 2,4-dimethyl-n-$BO_{1-2}$; 2,5-hexanediol, 2,5-dimethyl-n-$BO_{1-2}$; 2,5-hexanediol, 3,3-dimethyl-n-$BO_{1-2}$; 2,5-hexanediol, 3,4-dimethyl-n-$BO_{1-2}$; 3,5-heptanediol, 3-methyl-n-$BO_{1-2}$; 1,3-propanediol, 2-(1,2-dimethylpropyl)-n-$BO_1$; 1,3-butanediol, 2-ethyl-2,3-dimethyl-n-$BO_1$; 1,3-butanediol, 2-methyl-2-isopropyl-N-$BO_1$; 1,4-butanediol, 3-methyl-2-isopropyl-n-$BO_1$; 1,3-pentanediol, 2,2,3-trimethyl-n-$BO_1$; 1,3-pentanediol, 2,2,4-trimethyl-n-$BO_1$; 1,3-pentanediol, 2,4,4-trimethyl-n-$BO_1$; 1,3-pentanediol, 3,4,4-trimethyl-n-$BO_1$; 1,4-pentanediol, 2,2,3-trimethyl-n-$BO_1$; 1,4-pentanediol, 2,2,4-trimethyl-n-$BO_1$; 1,4-pentanediol, 2,3,3-trimethyl-n-$BO_1$; 1,4-pentanediol, 2,3,4-trimethyl-n-$BO_1$; 1,4-pentanediol, 3,3,4-trimethyl-n-$BO_1$; 2,4-pentanediol, 2,3,4-trimethyl-N-$BO_1$; 2,4-hexanediol, 4-ethyl-n-$BO_1$; 2,4-heptanediol, 2-methyl-n-$BO_1$; 2,4-heptanediol, 3-methyl-n-$BO_1$; 2,4-heptanediol, 4-methyl-n-$BO_1$; 2,4-heptanediol, 5-methyl-n-$BO_1$; 2,4-heptanediol, 6-methyl-n-$BO_1$; 2,5-heptanediol, 2-methyl-n-$BO_1$; 2,5-heptanediol, 3-methyl-n-$BO_1$; 2,5-heptanediol, 4-methyl-n-$BO_1$; 2,5-heptanediol, 5-methyl-n-$BO_1$; 2,5-heptanediol, 6-methyl-n-$BO_1$; 2,6-heptanediol, 2-methyl-n-$BO_1$; 2,6-heptanediol, 3-methyl-n-$BO_1$; 2,6-heptanediol, 4-methyl-n-$BO_1$; 3,5-heptanediol, 2-methyl-n-$BO_1$; 1,3-propanediol, 2-(1,2-dimethylpropyl)-$E_{1-3}$; 1,3-butanediol, 2-ethyl-2,3-dimethyl-$E_{1-3}$; 1,3-butanediol, 2-methyl-2-isopropyl-$E_{1-3}$; 1,4-butanediol, 3-methyl-2-isopropyl-$E_{1-3}$; 1,3-pentanediol, 2,2,3-trimethyl-$E_{1-3}$; 1,3-pentanediol, 2,2,4-trimethyl-$E_{1-3}$; 1,3-pentanediol, 2,4,4-trimethyl-$E_{1-3}$; 1,3-pentanediol, 3,4,4-trimethyl-$E_{1-3}$; 1,4-pentanediol, 2,2,3-trimethyl-$E_{1-3}$; 1,4-pentanediol, 2,2,4-trimethyl-$E_{1-3}$; 1,4-pentanediol, 2,3,3-trimethyl-$E_{1-3}$; 1,4-pentanediol, 2,3,4-trimethyl-$E_{1-3}$; 1,4-pentanediol, 3,3,4-trimethyl-$E_{1-3}$; 2,4-pentanediol, 2,3,4-trimethyl-$E_{1-3}$; 2,4-hexanediol, 4-ethyl-$E_{1-3}$; 2,4-heptanediol, 2-methyl-$E_{1-3}$; 2,4-heptanediol, 3-methyl-$E_{1-3}$; 2,4-heptanediol, 4-methyl-$E_{1-3}$; 2,4-heptanediol, 5-methyl-$E_{1-3}$; 2,4-heptanediol, 6-methyl-$E_{1-3}$; 2,5-heptanediol, 2-methyl-$E_{1-3}$; 2,5-heptanediol, 3-methyl-$E_{1-3}$; 2,5-heptanediol, 4-methyl-$E_{1-3}$; 2,5-heptanediol, 5-methyl-$E_{1-3}$; 2,5-heptanediol, 6-methyl-$E_{1-3}$; 2,6-heptanediol, 2-methyl-$E_{1-3}$; 2,6-heptanediol, 3-methyl-$E_{1-3}$; 2,6-heptanediol, 4-methyl-$E_{1-3}$; and/or 3,5-heptanediol, 2-methyl-$E_3$; and 7. mixtures thereof;

IX. aromatic diols including: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; 1-phenyl-1,4-butanediol; 2-phenyl-1,4-butanediol; and/or 1-phenyl-2,3-butanediol;

X. principal solvents which are homologs, or analogs, of the above structures where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant, including the following: 1,3-Propanediol, 2,2-di-2-propenyl-; 1,3-

Propanediol, 2-(1-pentenyl)-; 1,3-Propanediol, 2-(2-methyl-2-propenyl)-2-(2-propenyl)-; 1,3-Propanediol, 2-(3-methyl-1-butenyl)-; 1,3-Propanediol, 2-(4-pentenyl)-; 1,3-Propanediol, 2-ethyl-2-(2-methyl-2-propenyl)-1,3-Propanediol, 2-ethyl-2-(2-propenyl)-; 1,3-Propanediol, 2-methyl-2-(3-methyl-3-butenyl)-; 1,3-Butanediol, 2,2-diallyl-; 1,3-Butanediol, 2-(1-ethyl-1-propenyl)-; 1,3-Butanediol, 2-(2-butenyl)-2-methyl-; 1,3-Butanediol, 2-(3-methyl-2-butenyl)-; 1,3-Butanediol, 2-ethyl-2-(2-propenyl)-; 1,3-Butanediol, 2-methyl-2-(1-methyl-2-propenyl)-; 1,4-Butanediol, 2,3-bis(1-methylethylidene)-; 1,4-Butanediol, 2-(3-methyl-2-butenyl)-3-methylene-; 2-Butene-1,4-diol, 2-(1,1-dimethylpropyl)-; 2-Butene-1,4-diol, 2-(1-methylpropyl)-; 2-Butene-1,4-diol, 2-butyl-; 1,3-Pentanediol, 2-ethenyl-3-ethyl-; 1,3-Pentanediol, 2-ethenyl-4,4-dimethyl-; 1,4-Pentanediol, 3-methyl-2-(2-propenyl)-; 1,5-Pentanediol, 2-(1-propenyl)-; 1,5-Pentanediol, 2-(2-propenyl)-; 1,5-Pentanediol, 2-ethylidene-3-methyl-; 1,5-Pentanediol, 2-propylidene-; 2,4-Pentanediol, 3-ethylidene-2,4-dimethyl-; 4-Pentene-1,3-diol, 2-(1,1-dimethylethyl)-; 4-Pentene-1,3-diol, 2-ethyl-2,3-dimethyl-; 1,4-Hexanediol, 4-ethyl-2-methylene-; 1,5-Hexadiene-3,4-diol, 2,3,5-trimethyl-; 1,5-Hexadiene-3,4-diol, 5-ethyl-3-methyl-; 1,5-Hexanediol, 2-(1-methylethenyl)-; 1,6-Hexanediol, 2-ethenyl-; 1-Hexene-3,4-diol, 5,5-dimethyl-; 1-Hexene-3,4-diol, 5,5-dimethyl-; 2-Hexene-1,5-diol, 4-ethenyl-2,5-dimethyl-; 3-Hexene-1,6-diol, 2-ethenyl-2,5-dimethyl-; 3-Hexene-1,6-diol, 2-ethyl-; 3-Hexene-1,6-diol, 3,4-dimethyl-; 4-Hexene-2,3-diol, 2,5-dimethyl-; 4-Hexene-2,3-diol, 3,4-dimethyl-; 5-Hexene-1,3-diol, 3-(2-propenyl)-; 5-Hexene-2,3-diol, 2,3-dimethyl-; 5-Hexene-2,3-diol, 3,4-dimethyl-; 5-Hexene-2,3-diol, 3,5-dimethyl-; 5-Hexene-2,4-diol, 3-ethenyl-2,5-dimethyl-; 1,4-Heptanediol, 6-methyl-5-methylene-; 1,5-Heptadiene-3,4-diol, 2,3-dimethyl-; 1,5-Heptadiene-3,4-diol, 2,5-dimethyl-; 1,5-Heptadiene-3,4-diol, 3,5-dimethyl-; 1,7-Heptanediol, 2,6-bis(methylene)-; 1,7-Heptanediol, 4-methylene-; 1-Heptene-3,5-diol, 2,4-dimethyl-; 1-Heptene-3,5-diol, 2,6-dimethyl-; 1-Heptene-3,5-diol, 3-ethenyl-5-methyl; 1-Heptene-3,5-diol, 6,6-dimethyl-; 2,4-Heptadiene-2,6-diol, 4,6-dimethyl-; 2,5-Heptadiene-1,7-diol, 4,4-dimethyl-; 2,6-Heptadiene-1,4-diol, 2,5,5-trimethyl-; 2-Heptene-1,4-diol, 5,6-dimethyl-; 2-Heptene-1,5-diol, 5-ethyl-; 2-Heptene-1,7-diol, 2-methyl-; 3-Heptene-1,5-diol, 4,6-dimethyl-; 3-Heptene-1,7-diol, 3-methyl-6-methylene-; 3-Heptene-2,5-diol, 2,4-dimethyl-; 3-Heptene-2,5-diol, 2,5-dimethyl-; 3-Heptene-2,6-diol, 2,6-dimethyl-; 3-Heptene-2,6-diol, 4,6-dimethyl-; 5-Heptene-1,3-diol, 2,4-dimethyl-; 5-Heptene-1,3-diol, 3,6-dimethyl-; 5-Heptene-1,4-diol, 2,6-dimethyl-; 5-Heptene-1,4-diol, 3,6-dimethyl-; 5-Heptene-2,4-diol, 2,3-dimethyl-; 6-Heptene-1,3-diol, 2,2-dimethyl-; 6-Heptene-1,4-diol, 4-(2-propenyl)-; 6-Heptene-1,4-diol; 5,6-dimethyl-; 6-Heptene-1,5-diol, 2,4-dimethyl-; 6-Heptene-1,5-diol, 2-ethylidene-6-methyl-; 6-Heptene-2,4-diol, 4-(2-propenyl)-; 6-Heptene-2,4-diol, 5,5-dimethyl-; 6-Heptene-2,5-diol, 4,6-dimethyl-; 6-Heptene-2,5-diol, 5-ethenyl-4-methyl-; 1,3-Octanediol, 2-methylene-; 1,6-Octadiene-3,5-diol, 2,6-dimethyl-; 1,6-Octadiene-3,5-diol, 3,7-dimethyl-; 1,7-Octadiene-3,6-diol, 2,6-dimethyl-; 1,7-Octadiene-3,6-diol, 2,7-dimethyl-; 1,7-Octadiene-3,6-diol, 3,6-dimethyl-; 1-Octene-3,6-diol, 3-ethenyl-; 2,4,6-Octatriene-1,8-diol, 2,7-dimethyl-; 2,4-Octadiene-1,7-diol, 3,7-dimethyl-; 2,5-Octadiene-1,7-diol, 2,6-dimethyl-; 2,5-Octadiene-1,7-diol, 3,7-dimethyl-; 2,6-Octadiene-1,4-diol, 3,7-dimethyl-(Rosiridol); 2,6-Octadiene-1,8-diol, 2-methyl-; 2,7-Octadiene-1,4-diol, 3,7-dimethyl-; 2,7-Octadiene-1,5-diol, 2,6-dimethyl-; 2,7-Octadiene-1,6-diol, 2,6-dimethyl-(8-Hydroxylinalool); 2,7-Octadiene-1,6-diol, 2,7-dimethyl-; 2-Octene-1,4-diol; 2-Octene-1,7-diol; 2-Octene-1,7-diol, 2-methyl-6-methylene-; 3,5-Octadiene-1,7-diol, 3,7-dimethyl-; 3,5-Octadiene-2,7-diol, 2,7-dimethyl-; 3,5-Octanediol, 4-methylene-; 3,7-Octadiene-1,6-diol, 2,6-dimethyl-; 3,7-Octadiene-2,5-diol, 2,7-dimethyl-; 3,7-Octadiene-2,6-diol, 2,6-dimethyl-; 3-Octene-1,5-diol, 4-methyl-; 3-Octene-1,5-diol, 5-methyl-; 4,6-Octadiene-1,3-diol, 2,2-dimethyl-; 4,7-Octadiene-2,3-diol, 2,6-dimethyl-; 4,7-Octadiene-2,6-diol, 2,6-dimethyl-; 4-Octene-1,6-diol, 7-methyl-; 2,7-bis(methylene)-; 2-methylene-; 5,7-Octadiene-1,4-diol, 2,7-dimethyl-; 5,7-Octadiene-1,4-diol, 7-methyl-; 5-Octene-1,3-diol; 6-Octene-1,3-diol, 7-methyl-; 6-Octene-1,4-diol, 7-methyl-; 6-Octene-1,5-diol; 6-Octene-1,5-diol, 7-methyl-; 6-Octene-3,5-diol, 2-methyl-; 6-Octene-3,5-diol, 4-methyl-; 7-Octene-1,3-diol, 2-methyl-; 7-Octene-1,3-diol, 4-methyl-; 7-Octene-1,3-diol, 7-methyl-; 7-Octene-1,5-diol; 7-Octene-1,6-diol; 7-Octene-1,6-diol, 5-methyl-; 7-Octene-2,4-diol, 2-methyl-6-methylene-; 7-Octene-2,5-diol, 7-methyl-; 7-Octene-3,5-diol, 2-methyl-; 1-Nonene-3,5-diol; 1-Nonene-3,7-diol; 3-Nonene-2,5-diol; 4,6-Nonadiene-1,3-diol, 8-methyl-; 4-Nonene-2,8-diol; 6,8-Nonadiene-1,5-diol; 7-Nonene-2,4-diol; 8-Nonene-2,4-diol; 8-Nonene-2,5-diol; 1,9-Decadiene-3,8-diol; and/or 1,9-Decadiene-4,6-diol; and XI. mixtures thereof;

The clear compositions can optionally, but preferably, contain:

(1) an effective amount, sufficient to improve clarity, of low molecular weight water soluble solvents like ethanol, isopropanol, propylene glycol, 1,3-propanediol, propylene carbonate, etc., said water soluble solvents being at a level that will not form clear compositions by themselves;

(2) optionally, but preferably, from 0% to about 15%, preferably from about 0.1% to about 8%, and more preferably from about 0.2% to about 5%, of perfume;

(3) optionally, from 0% to about 2%, preferably from about 0.01% to about 0.2%, and more preferably from about 0.035% to about 0.1%, of stabilizer; and (4) optionally, an effective amount to improve clarity, of water soluble calcium and/or magnesium salt, preferably chloride.

The balance of the composition is typically water.

Preferably, the compositions herein are aqueous, translucent or clear, preferably clear, compositions containing from about 3% to about 95%, preferably from about 10% to about 80%, more preferably from about 30% to about 70%, and even more preferably from about 40% to about 60%, water and from about 5% to about 40%, preferably from about 7% to about 35%, more preferably from about 10% to about 25%, and even more preferably from about 12% to about 18%, of the above principal alcohol solvent B. These preferred products (compositions) are not translucent or clear without principal solvent B. The amount of principal solvent B. used to make the compositions translucent or clear is preferably more than 50%, more preferably more than about 60%, and even more preferably more than about 75%, of the total organic solvent present.

The principal solvents are desirably kept to the lowest levels that provide acceptable stability/clarity in the present compositions. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 3% to about 15%, the softener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At higher water levels, the softener to principal solvent ratios should be even higher.

For dispersion products the levels of active are from about 5% to about 35%, preferably from about 8% to about 30%, more preferably from about 10% to about 28%, and even more preferably from about 13% to about 26%, of said compound, or mixtures of such compounds.

The pH of the compositions should be from about 1 to about 5, preferably from about 2 to about 4, more preferably from about 3 to about 4.

DETAILED DESCRIPTION OF THE INVENTION

I. Fabric Softening Active

Clear fabric softening compositions of the present invention contain as an essential component from about 2% to about 75%, preferably from about 8% to about 70%, more preferably from about 13% to about 65%, and even more preferably from about 18% to about 40% by weight of the composition, of the specific essential fabric softener active disclosed hereinabove having the formula:

$$[RC(O)OC_2H_4]_nN^+(R^1)_mX^-$$

wherein each R in a compound is a $C_6$–$C_{22}$ hydrocarbyl group, preferably having an IV from about 70 to about 140 based upon the IV of the equivalent fatty acid with the cis/trans ratio preferably being as described hereinafter, n is a number from 1 to three on the weight average in any mixture of compounds, each $R^1$ in a compound is a $C_{1-3}$ alkyl or hydroxy alkyl group, the total of n and the number of $R^1$ groups that are hydroxyethyl groups equaling 3, n+m equaling 4, and X is a softener compatible anion, preferably methyl sulfate. Preferably the cis:trans isomer ratio of the fatty acid (of the C18:1 component) is at least about 1:1, preferably about 2:1, more preferably 3:1, and even more preferably about 4:1, or higher.

The compound, or mixtures of compounds, have (a) either a Hunter "L" transmission of at least about 85, typically from about 85 to about 95, preferably from about 90 to about 95, more preferably above about 95, if possible, (b) only low, relatively non-dectectable levels, at the conditions of use, of odorous compounds selected from the group consisting of: isopropyl acetate; 2,2'-ethylidenebis(oxy) bispropane; 1,3,5-trioxane; and/or short chain fatty acid (4–12, especially 6–10, carbon atoms) esters, especially methyl esters; or (c) preferably, both.

The Hunter L transmission is measured by (1) mixing the softener active with solvent at a level of about 10% of active, to assure clarity, the preferred solvent being ethoxylated (one mole EO) 2,2,4-trimethyl-1,3-pentanediol and (2) measuring the L color value against distilled water with a Hunter ColorQUEST® calorimeter made by Hunter Associates Laboratory, Reston, Va.

The level of odorant is defined by measuring the level of odorant in a headspace over a sample of the softener active (about 92% active). Chromatograms are generated using 200 mL of head space sample over about 2 grams of sample. The head space sample is trapped on to a solid absorbent and thermally desorbed onto a column directly via cryofocussing at about −100° C. The identifications of materials is based on the peaks in the chromatograms. Some impurities identified are related to the solvent used in the quaternization process, (e.g., ethanol and isopropanol). The ethoxy and methoxy ethers are typically sweet in odor. There are $C_6$–$C_8$ methyl esters found in the current commercial samples, but not in the typical softener actives of this invention. These esters contribute to the perceived poorer odor of the current commercial samples. The level of each odorant found in a typical commercial sample is as follows:

Approximate concentration of head space impurities

| | Gas phase concentration (ng/L) | |
|---|---|---|
| Chemical Identification | Commercial sample | Typical invention sample |
| Isopropyl acetate | 6 | <1 |
| 1,3,5-trioxane | 61 | 5 |
| 2,2'-ethylidenebis(oxy)-bispropane | 244 | <1 |
| C6 methyl ester | 10 | <1 |
| C8 Methyl ester | 9 | <1 |
| C10 Methyl ester | 4 | <1 |

The acceptable level of each odorant is as follows: isopropyl acetate should be less than about 5, preferably less than about 3, and more preferably less than about 2, nanograms per liter (ηg/l.); 2,2'-ethylidenebis(oxy)bispropane should be less than about 200, preferably less than about 100, more preferably less than about 10, and even more preferably less than about 5, nanograms per liter (ηg/L.); 1,3,5-trioxane should be less than about 50, preferably less than about 20, more preferably less than about 10, and even more preferably less than about 7, nanograms per liter (ηg/L.); and/or each short chain fatty acid (4–12, especially 6–10, carbon atoms) ester, especially methyl esters should be less than about 4, preferably less than about 3, and more preferably less than about 2, nanograms per liter (ηg/L.).

The elimination of color and odor materials can either be accomplished after formation of the compound, or, preferably, by selection of the reactants and the reaction conditions. Preferably, the reactants are selected to have good odor and color. For example, it is possible to obtain fatty acids, or their esters, for sources of the long fatty acyl group, that have good color and odor and which have extremely low levels of short chain ($C_{4-12}$, especially $C_{6-10}$) fatty acyl groups. Also, the reactants can be cleaned up prior to use. For example, the fatty acid reactant can be double or triple distilled to remove color and odor causing bodies and remove short chain fatty acids. Additionally, the color of the triethanolamine reactant needs to be controlled to a low color level (e.g. a color reading of about 20 or less on the APHA scale). The degree of clean up required is dependent on the level of use and the presence of other ingredients. For example, adding a dye can cover up some colors. However, for clear and/or light colored products, the color must be almost non-detectable. This is especially true for higher levels of active, e.g., from about 8% to about 75%, preferably from about 13% to about 60%, more preferably from about 18% to about 40%, of the softener active by weight of the composition. Similarly, the odor can be covered up by higher levels of perfume, but at the higher levels of softener active there is a relatively high cost associated with such an approach, especially in terms of having to compromise the odor quality. Odor quality can be further improved by use of ethanol as the quaternization reaction solvent.

Preferred biodegradable fabric softener compounds comprise quaternary ammonium salt, the quaternized ammonium salt being a quaternized product of condensation between:

a)—a fraction of saturated or unsaturated, linear or branched fatty acids, or of derivatives of said acids, said fatty acids or derivatives each possessing a hydrocarbon chain in which the number of atoms is between 5 and 21, and b)—triethanolamine, characterized in that said condensation product has an acid value, measured by titration of the condensation product with a standard KOH solution against a phenolphthalein indicator, of less than about 6.5.

The acid value is preferably less than or equal to about 5, more preferably less than about 3. Indeed, the lower the AV, the better softness softness performance is obtained. The acid value is determined by titration of the condensation product with a standard KOH solution against a phenolphthalein indicator according to ISO#53402. The AV is expressed as mg KOH/g.

For optimum softness benefit, it is preferred that the reactants are present in a molar ratio of fatty acid fraction to triethanolamine of from about 1:1 to about 2.5:1.

It has also been found that the optimum softness performance is also affected by the detergent carry-over laundry conditions, and more especially by the presence of the anionic surfactant in the solution in which the softening composition is used. Indeed, the presence of anionic surfactant that is usually carried over from the wash will interact with the softener compound, thereby reducing its performance. Thus, depending on usage conditions, the mole ratio of fatty acid/triethanolamine can be critical. Accordingly, where no rinse occurs between the wash cycle and the rinse cycle containing the softening compound, a high amount of anionic surfactant will be carried over in the rinse cycle containing the softening compound. In this instance, it has been found that a fatty acid fraction/triethanolamine mole ratio of about 1.4:1 to about 1.8:1 is preferred. By high amount of anionic surfactant, it is meant that the presence of anionic in the rinse cycle at a level such that the molar ratio anionic surfactant/cationic softener compound of the invention is at least about 1/10.

Thus, according to another aspect of the invention, there is provided a method of treating fabrics which comprises the step of contacting the fabrics in an aqueous medium containing the softener compound of the invention or softening composition thereof wherein the fatty acid/triethanolamine mole ratio in the softener compound is from about 1.4:1 to about 1.8:1, preferably about 1.5:1 and the aqueous medium comprises a molar ratio of anionic surfactant to said softener compound of the invention of at least about 1:10.

Where, on the other hand, an intermediate rinse cycle occurs between the wash and the later rinse cycle, less anionic surfactant, i.e. less than about 1:10 of a molar ratio anionic surfactant to cationic compound of the invention, will then be carried over. Accordingly, it has been found that a fatty acid/triethanolamine mole ratio of about 1.8:1 to about 2.2:1 is then preferred. Accordingly, in another aspect of the invention, there is provided a method of treating fabrics which comprises the step of contacting the fabrics in an aqueous medium containing the softener compound of the invention or softening composition thereof wherein the fatty acid/triethanolamine mole ratio in the softener compound is from about 1.8:1 to about 2:1, preferably about 2.0:1 and the aqueous medium comprises a molar ratio of anionic surfactant to said softener compound of the invention of less than about 1:10.

In a preferred embodiment of the invention, the fatty acid fraction and the triethanolamine are present in a molar ratio of from about 1:1 to about 2.5:1.

Preferred cationic, preferably biodegradable quaternary, ammonium fabric softening compounds can contain the group —(O)CR which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) have the following approximate distributions:

| Fatty Acyl Group | FA[1] | FA[2] | FA[3] | FA[4] | FA[5] |
|---|---|---|---|---|---|
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | 0 |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |
| Unknowns | 0 | 0 | 6 | 6 | 7 |
| Total | 99 | 99 | 100 | 100 | 102 |
| IV | 86–90 | 88–95 | 99 | 100 | 95 |
| cis/trans (C18:1) | 20–30 | 20–30 | 4 | 5 | 5 |
| TPU | 4 | 9 | 10 | 13 | 13 |

TPU is the percentage of polyunsaturates present.

Mixtures of fatty acids, and mixtures of FAs that are derived from different fatty acids can be used, and are preferred. Nonlimiting examples of FA's that can be blended, to form FA's of this invention are as follows:

| Fatty Acyl Group | FA[6] | FA[7] |
|---|---|---|
| C14 | 0 | 1 |
| C16 | 11 | 25 |
| C18 | 4 | 20 |
| C14:1 | 0 | 0 |
| C16:1 | 1 | 0 |
| C18:1 | 27 | 45 |
| C18:2 | 50 | 6 |
| C18:3 | 7 | 0 |
| Unknowns | 0 | 3 |
| Total | 100 | 100 |
| IV | 125–138 | 56 |

-continued

| Fatty Acyl Group | $FA^6$ | $FA^7$ |
|---|---|---|
| cis/trans (C18:1) | Not Available | 7 |
| TPU | 57 | 6 |

$FA^6$ is prepared from a soy bean fatty acid, and $FA^7$ is prepared from a slightly hydrogenated tallow fatty acid.

The more preferred essential softener actives containing an effective amount of molecules containing two ester linked hydrophobic groups [RC(CO)O—], said actives being referred to hereinafter as "DEQA's", are those that are prepared as a single DEQA from blends of all the different fatty acids that are represented (total fatty acid blend), rather than from blends of mixtures of separate finished DEQA's that are prepared from different portions of the total fatty acid blend.

It is preferred that at least a majority of the fatty acyl groups are unsaturated, e.g., from about 50% to 100%, preferably from about 55% to about 95%, more preferably from about 60% to about 90%, and that the total level of active containing polyunsaturated fatty acyl groups (TPU) be preferably from about 3% to about 30%. The cis/trans ratio for the unsaturated fatty acyl groups is usually important, with the cis/trans ratio being from about 1:1 to about 50:1, the minimum being about 1:1, preferably at least 3:1, and more preferably from about 4:1 to about 20:1. (As used herein, the "percent of softener active" containing a given R group is the same as the percentage of that same R group is to the total R groups used to form all of the softener actives.)

The unsaturated, including the preferred polyunsaturated, fatty acyl and/or alkylene groups, discussed hereinbefore and hereinafter, surprisingly provide effective softening, but also provide better rewetting characteristics, good antistatic characteristics, and especially, superior recovery after freezing and thawing.

The highly unsaturated materials are also easier to formulate into concentrated premixes that maintain their low viscosity and are therefore easier to process, e.g., pump, mixing, etc. These highly unsaturated materials (total level of active containing polyunsaturated fatty acyl groups (TPU) being typically from about 3% to about 30%, with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it mimimizes degradation. Additional protection against degradation can be provided when the compounds and softener compositions contain effective antioxidants, chelants, and/or reducing agents, as disclosed hereinafter.

It will be understood that substituents R and $R^1$ can optionally be substituted with various groups such as alkoxyl or hydroxyl groups, and can be straight, or branched so long as the R groups maintain their basically hydrophobic character.

A preferred long chain DEQA is the DEQA prepared from sources containing high levels of polyunsaturation, i.e., N,N-di(acyl-oxyethyl)-N,N-methylhydroxyethylammonium methyl sulfate, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-di(oleoyl-oxyethyl)-N,N-methylhydroxyethylammonium methyl sulfate is the major ingredient. Preferred sources of fatty acids for such DEQAs are vegetable oils, and/or partially hydrogenated vegetable oils, with high contents of unsaturated, e.g., oleoyl groups.

As used herein, when the DEQA diester (n=2) is specified, it can include the monoester (n=1) and/or triester (n=3) that are present. Preferably, at least about 30% of the DEQA is in the diester form, and from 0% to about 30% can be DEQA monoester, e.g., there are three $R^1$ group. For softening, under no/low detergent carry-over laundry conditions the percentage of monoester should be as low as possible, preferably no more than about 15%. However, under high, anionic detergent surfactant or detergent builder carry-over conditions, some monoester can be preferred. The overall ratios of diester quat to monoester quat are from about 2.5:1 to about 1:1, preferably from about 2.3:1 to about 1.3:1. Under high detergent carry-over conditions, the di/monoester ratio is preferably about 1.3:1. The level of monoester present can be controlled in manufacturing the DEQA by varying the ratio of fatty acid, or fatty acyl source, to triethanolamine. The overall ratios of diester quat to triester quat are from about 10:1 to about 1.5:1, preferably from about 5:1 to about 2.8:1.

The above compounds, used as the essential biodegradable quarternized ester-amine softening material in the practice of this invention, can be prepared using standard reaction chemistry. In one synthesis of a di-ester variation of DTDMAC, an amine of the formula $N(CH_2CH_2OH)_3$ is esterified, preferably at two hydroxyl groups, with an acid chloride of the formula RC(O)Cl, to form an amine which can be made cationic by acidification (one R is H) to be one type of softener, or then quarternized with an alkyl halide, $R^1X$, to yield the desired reaction product (wherein R and $R^1$ are as defined hereinbefore). However, it will be appreciated by those skilled in the chemical arts that this reaction sequence allows a broad selection of agents to be prepared.

In preferred DEQA softener actives, each R is a hydrocarbyl, or substituted hydrocarbyl, group, preferably, alkyl, monounsaturated alkenyl, and polyunsaturated alkenyl groups, with the softener active containing polyunsaturated alkenyl groups being preferably at least about 3%, more preferably at least about 5%, more preferably at least about 10%, and even more preferably at least about 15%, by weight of the total softener active present; the actives preferably containing mixtures of R groups, especially within the individual molecules.

In preferred quaternary ammonium fabric softening compounds, and especially in the DEQAs, RC(O)O is derived from unsaturated fatty acid, e.g., oleic acid, and/or fatty acids and/or partially hydrogenated fatty acids, derived from animal fats, vegetable oils and/or partially hydrogenated vegetable oils, such as: canola oil; safflower oil; peanut oil; sunflower oil; soybean oil; corn oil; tall oil; rice bran oil; etc.] [As used herein, similar biodegradable fabric softener actives containing ester linkages are referred to as "DEQA", which includes both diester, triester, and monoester compounds containing from one to three, preferably two, long chain hydrophobic groups. These fabric softener actives have the characteristic that they can be processed by conventional mixing means at ambient temperature, at least in the presence of about 15% of solvent C. as disclosed hereinbefore.

The DEQAs herein can also contain a low level of fatty acid, which can be from unreacted starting material used to form the DEQA and/or as a by-product of any partial degradation (hydrolysis) of the softener active in the finished composition. It is preferred that the level of free fatty acid be low, preferably below about 15%, more preferably below about 10%, and even more preferably below about 5%, by weight of the softener active.

Preferred Process for Preparing Softener Actives

The fabric softener actives of the present invention are preferably prepared by a process wherein a chelant, preferably a diethylenetriaminepentaacetate (DTPA) and/or an ethylene diamine-N,N'-disuccinate (EDDS) is added to the process. Also, preferably, antioxidants are added to the fatty acid immediately after distillation and/or fractionation and/or during the esterification reactions and/or prior to, or during, the quaternization reaction, and/or post-added to the finished softener active. The resulting softener active has reduced discoloration and malodor associated therewith. The typical process comprises the steps of:

a) providing a source of triglyceride and reacting the source of triglyceride to form a mixture of fatty acids and/or fatty acid esters;

b) using the mixture formed from step (a) to react under esterification conditions with triethanolamine;

c) quaternizing, if desired, the mixture of fatty acid esters formed from step (b) by reacting the mixture under quaternizing conditions with a quaternizing agent of the formula $R^1X$ wherein $R^1$ is defined as in step (b) and X is a softener compatible anion, preferably selected from the group consisting of chloride, bromide, methylsulfate, ethylsulfate, sulfate, and nitrate thereby forming a quaternary fabric softener active, the methyl sulfate and ethyl sulfate being highly preferred, wherein at least step (c) is carried out in the presence of a chelating agent selected from the group consisting of diethylenetriaminepentaacetic acid, ethylenediamine-N,N'-disuccinnic acid and mixtures thereof.

The step of reacting the source of triglyceride can further include reacting in the presence of the chelating agent step (b) can further include the presence of the chelating agent.

The total amount of added chelating agent is preferably within the range of from about 10 ppm to about 5,000 ppm, more preferably within the range of from about 100 ppm to about 2500 ppm by weight of the formed softener active. The source of triglyceride is preferably selected from the group consisting of animal fats, vegetable oils, partially hydrogenated vegetable oils, and mixtures thereof. More preferably, the vegetable oil or partially hydrogenated vegetable oil is selected from the group consisting of canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Most preferably, the source of triglyceride is canola oil, partially hydrogenated canola oil, and mixtures thereof. The process can also include the step of adding from about 0.01% to about 2% by weight of the composition of an antioxidant compound to any or all of steps (a), (b) or (c).

The above processes produce a fabric softener active with reduced coloration and malodor.

The present invention also includes a process for the preparation of a fabric softening premix composition. This method comprises preparing a fabric softening active as described above and mixing the fabric softener active, optionally containing a low molecular weight solvent, with a principal solvent having a ClogP of from about 0.15 to about 0.64 thereby forming a fabric softener premix. The premix can comprise from about 55% to about 85% by weight of fabric softening active and from about 10% to about 30% by weight of a principal solvent. The process can further comprise the step of adding a low molecular weight water soluble solvent selected from the group consisting of: ethanol, isopropanol, propylene glycol, 1,3-propanediol, propylene carbonate, hexylene glycol and mixtures thereof to the premix. Again, the process can also include the step of adding from about 0.01% to about 2% by weight of the composition of an antioxidant compound to any or all of steps (a), (b) or (c). The products of the above process are new compositions.

A process for preparing a fabric softening composition in the form of a dispersion comprises the steps of forming a premix as described above and the steps of forming a water seat by combining water and a mineral acid; and mixing the premix and the water seat with agitation to form a fabric softening composition. The process can further comprise one or more steps, including the steps of adjusting the viscosity of the fabric softening composition with the addition of a solution of calcium chloride, adding a chelating agent to the water seat and adding a perfume ingredient to the premix, or, preferably, the finished product. The products of the above process are also new compositions.

II. Optional, but Preferred, Principal Solvent System

The compositions of the present invention comprise less than about 40%, preferably from about 10% to about 35%, more preferably from about 12% to about 25%, and even more preferably from about 14% to about 20%, of the principal solvent, by weight of the composition. Said principal solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The suitability of any principal solvent for the formulation of the liquid, concentrated, preferably clear, fabric softener compositions herein with the requisite stability is surprisingly selective. Suitable solvents can be selected based upon their octanol/water partition coefficient (P). Octanol/water partition coefficient of a principal solvent is the ratio between its equilibrium concentration in octanol and in water. The partition coefficients of the principal solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The principal solvents herein are selected from those having a ClogP of from about 0.15 to about 0.64, preferably from about 0.25 to about 0.62, and more preferably from about 0.40 to about 0.60, said principal solvent preferably being asymmetric, and preferably having a melting, or solidification, point that allows it to be liquid at, or near room temperature. Solvents that have a low molecular weight and are biodegradable are also desirable for some purposes. The more asymmetric solvents appear to be very desirable, whereas the highly symmetrical solvents, having a center of symmetry, such as 1,7-heptanediol, or 1,4-bis (hydroxymethyl)cyclohexane, appear to be unable to provide the essentially clear compositions when used alone, even though their ClogP values fall in the preferred range. One can select the most suitable principal solvent by determining whether a composition containing about 27% di(oleyoyloxyethyl)dimethylammonium chloride, about 16–20% of principal solvent, and about 4–6% ethanol remains clear during storage at about 40° F. (about 4.4° C.) and recovers from being frozen at about 0° F. (about −18° C.).

The most preferred principal solvents can be identified by the appearance of the dilute treatment compositions used to treat fabrics. These dilute compositions have dispersions of fabric softener that exhibit a more uni-lamellar appearance than conventional fabric softener compositions which have a more multi-lamellar appearance. The closer to uni-lamellar the appearance, the better the compositions seem to perform. These preferred compositions appear to provide more uniform coverage upon deposition onto fabrics. These compositions provide surprisingly good fabric softening as compared to similar compositions prepared in the conventional way with the same fabric softener active. The compositions can inherently provide improved perfume deposition of some components as compared to conventional fabric softening compositions, especially when the perfume is added to the compositions at, or near, room temperature.

Operable principal solvents have been disclosed hereinbefore. A more specific disclosure, listed under various listings, e.g., aliphatic and/or alicyclic diols with a given number of carbon atoms; monols; derivatives of glycerine; alkoxylates of diols; and mixtures of all of the above can be found in PCT application WO 97/03169 published on Jan. 30, 1997, said application being incorporated herein by reference, the most pertinent disclosure appearing at pages 24–82 and 94–108 (methods of preparation) of the said WO 97/03169 specification. The disclosure contains reference numbers to the Chemical Abstracts Service Registry numbers (CAS No.) for those compounds that have such a number and the other compounds have a method described, that can be used to prepare the compounds. Some inoperable principal solvents are also listed in the disclosure. The inoperable principal solvents, however, can be used in mixtures with operable principal solvents. Operable principal solvents can be used to make concentrated fabric softener compositions that meet the stability/clarity requirements set forth herein.

Many diol principal solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos: 146452-51-9; 146452-50-8; 146452-49-5; 146452-48-4; 123807-34-1; 123807-33-0; 123807-32-9; and 123807-31-8.

In the PCT specification, each chemical formula is listed with only one CAS No. This disclosure is only for exemplification and is sufficient to allow the practice of the invention. The disclosure is not limiting. Therefore, it is understood that other isomers with other CAS Nos, and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa. A similar disclosure appears in the copending application, Ser. No. 08/679,694, filed Jul. 11, 1996 in the names of E. H. Wahl, T. Trinh, E. P. Gosselink, J. C. Letton, and M. R. Sivik, for Fabric Softening Compound/Composition, said application being incorporated herein by reference.

There are no $C_{1-2}$ mono-ols that provide the clear concentrated fabric softener compositions of this invention. Only one $C_3$ mono-ol, n-propanol, provides acceptable performance (forms a clear product and either keeps it clear to a temperature of about 4° C., or allows it to recover upon rewarming to room temperature), although its boiling point (BP) is undesirably low. Of the $C_4$ mono-ols, only 2-butanol and 2-methyl-2-propanol provide very good performance, but 2-methyl-2-propanol has a BP that is undesirably low. There are no $C_{5-6}$ mono-ols that provide clear products except for unsaturated mono-ols as described above and hereinafter.

Principal solvents which have two hydroxyl groups in their chemical formulas are suitable for use in the formulation of the liquid concentrated, clear fabric softener compositions of this invention. The suitability of each principal solvent is surprisingly very selective, dependent on the number of carbon atoms, the isomeric configuration of the molecules having the same number of carbon atoms, the degree of unsaturation, etc. Principal solvents with similar solubility characteristics to the principal solvents above and possessing at least some asymmetry will provide the same benefit. The suitable principal solvents have a ClogP of from about 0.15 to about 0.64, preferably from about 0.25 to about 0.62, and more preferably from about 0.40 to about 0.60.

For example, for the 1,2-alkanediol principal solvent series having the general formula HO—$CH_2$—CHOH—$(CH_2)_n$—H, with n being from 1 to 8, only 1,2-hexanediol (n=4), which has a ClogP value of about 0.53, which is within the effective ClogP range of from about 0.15 to about 0.64, is a good principal solvent, and is within the claim of this invention, while the others, e.g., 1,2-propanediol, 1,2-butanediol, 1,2-pentanediol, 1,2-octanediol, 1,2-decanediol, having ClogP values outside the effective 0.15–0.64 range, are not. Furthermore, of the hexanediol isomers, again, the 1,2-hexanediol is a good principal solvent, while many other isomers such as 1,3-hexanediol, 1,4-hexanediol, 1,5-hexanediol, 1,6-hexanediol, 2,4-hexanediol, and 2,5-hexanediol, having ClogP values outside the effective 0.15–0.64 range, are not.

There are no $C_{3-C5}$ diols that provide a clear concentrated composition in the context of this invention.

Although there are many $C_6$ diols that are possible isomers, only the ones listed above are suitable for making clear products and only: 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and 1,2-hexanediol are preferred, of which the most preferred are: 1,2-butanediol, 2-ethyl-; 1,2-pentanediol, 2-methyl-; 1,2-pentanediol, 3-methyl-; 1,2-pentanediol, 4-methyl-; and 1,2-hexanediol.

There are more possible $C_7$ diol isomers, but only the listed ones provide clear products and the preferred ones are: 1,3-butanediol, 2-butyl-; 1,4-butanediol, 2-propyl-; 1,5-pentanediol, 2-ethyl-; 2,3-pentanediol, 2,3-dimethyl-; 2,3-pentanediol, 2,4-dimethyl-; 2,3-pentanediol, 4,4-dimethyl-; 3,4-pentanediol, 2,3-dimethyl-; 1,6-hexanediol, 2-methyl-; 1,6-hexanediol, 3-methyl-; 1,3-heptanediol; 1,4-heptanediol; 1,5-heptanediol; 1,6-heptanediol; of which the most preferred are: 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; and 3,4-pentanediol, 2,3-dimethyl-.

Similarly, there are even more $C_8$ diol isomers, but only the listed ones provide clear products and the preferred ones are: 1,3-propanediol, 2-(1,1-dimethylpropyl)-; 1,3-propanediol, 2-(1,2-dimethylpropyl)-; 1,3-propanediol, 2-(1-ethylpropyl)-; 1,3-propanediol, 2-(2,2-dimethylpropyl)-; 1,3-propanediol, 2-ethyl-2-isopropyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-propyl-; 1,3-butanediol, 2-methyl-2-isopropyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4,trimethyl-; 1,5-pentanediol, 2,3,3-trimethyl-; 2,4-pentanediol, 2,3,4-trimethyl-; 1,3-5 pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-2-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol of which the following are the most preferred: 1,3-propanediol, 2-(1,1-dimethylpropyl)-; 1,3-propanediol, 2-(1,2-dimethylpropyl)-; 1,3-propanediol, 2-(1-ethylpropyl)-; 1,3-propanediol, 2-(2,2-dimethylpropyl)-; 1,3-propanediol, 2-ethyl-2-isopropyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2-(1-methylpropyl)-; 1,3-butanediol, 2-(2-methylpropyl)-; 1,3-butanediol, 2-butyl-; 1,3-butanediol, 2-methyl-2-propyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,3-pentanediol, 2,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol.

Preferred mixtures of eight-carbon-atom-1,3 diols can be formed by the condensation of mixtures of butyraldehyde, isobutyraldehyde and/or methyl ethyl ketone (2-butanone), so long as there are at least two of these reactants in the reaction mixture, in the presence of highly alkaline catalyst followed by conversion by hydrogenation to form a mixture of eight-carbon-1,3-diols, i.e., a mixture of 8-carbon-1,3-diols primarily consisting of: 2,2,4-trimethyl-1,3-pentanediol; 2-ethyl-1,3-hexanediol; 2,2-dimethyl-1,3-hexanediol; 2-ethyl-4-methyl-1,3-pentanediol; 2-ethyl-3-methyl-1,3-pentanediol; 3,5-octanediol; 2,2-dimethyl-2,4-hexanediol; 2-methyl-3,5-heptanediol; and/or 3-methyl-3,5-heptanediol, the level of 2,2,4-trimethyl-1,3-pentanediol being less than half of any mixture, possibly along with other minor isomers resulting from condensation on the methylene group of 2-butanone, when it is present, instead of on the methyl group.

The formulatability, and other properties, such as odor, fluidity, melting point lowering, etc., of some $C_{6-8}$ diols listed in Tables II–IV in the said PCT specification which are not preferred, can be improved by polyalkoxylation. Also, some of the $C_{3-5}$ diols which are alkoxylated are preferred. Preferred alkoxylated derivatives of the above $C_{3-8}$ diols [In the following disclosure, "EO" means polyethoxylates, "En" means —$(CH_2CH_2O)_nH$; Me-$E_n$ means methyl-capped polyethoxylates —$(CH_2CH_2O)_nCH_3$; "2(Me-En)" means 2 Me-En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly (n-butyleneoxy) groups —$(CH_2CH_2CH_2CH_2O)_nH$.] include:

1. 1,2-propanediol (C3) 2(Me-$E_{3-4}$); 1,2-propanediol (C3) $PO_4$; 1,2-propanediol, 2-methyl-(C4) (Me-$E_{8-10}$); 1,2-propanediol, 2-methyl-(C4) 2(Me-$E_1$); 1,2-propanediol, 2-methyl-(C4) $PO_3$; 1,3-propanediol (C3) 2(Me-$E_8$); 1,3-propanediol (C3) $PO_6$; 1,3-propanediol, 2,2-diethyl-(C7) $E_{4-7}$; 1,3-propanediol, 2,2-diethyl-(C7) $PO_1$; 1,3-propanediol, 2,2-diethyl-(C7) n-$BO_2$; 1,3-propanediol, 2,2-dimethyl-(C5) 2(Me $E_{1-2}$); 1,3-propanediol, 2,2-dimethyl-(C5) $PO_4$; 1,3-propanediol, 2-(1-methylpropyl)-(C7) $E_{4-7}$; 1,3-propanediol, 2-(1-methylpropyl)-(C7) $PO_1$; 1,3-propanediol, 2-(1-methylpropyl)-(C7) n-$BO_2$; 1,3-propanediol, 2-(2-methylpropyl)-(C7) $E_{4-7}$; 1,3-propanediol, 2-(2-methylpropyl)-(C7) $PO_1$; 1,3-propanediol, 2-(2-methylpropyl)-(C7) n-$BO_2$; 1,3-propanediol, 2-ethyl-(C5) (Me $E_{9-10}$); 1,3-propanediol, 2-ethyl-(C5) 2(Me $E_1$); 1,3-propanediol, 2-ethyl-(C5) $PO_3$; 1,3-propanediol, 2-ethyl-2-methyl-(C6) (Me $E_{3-6}$); 1,3-propanediol, 2-ethyl-2-methyl-(C6) $PO_2$; 1,3-propanediol, 2-ethyl-2-methyl-(C6) $BO_1$; 1,3-propanediol, 2-isopropyl-(C6) (Me $E_{3-6}$); 1,3-propanediol, 2-isopropyl-(C6) $PO_2$; 1,3-propanediol, 2-isopropyl-(C6) $BO_1$; 1,3-propanediol, 2-methyl-(C4) 2(Me $E_{4-5}$); 1,3-propanediol, 2-methyl-(C4) $PO_5$; 1,3-propanediol, 2-methyl-(C4) $BO_2$; 1,3-propanediol, 2-methyl-2-isopropyl-(C7) $E_{6-9}$; 1,3-propanediol, 2-methyl-2-isopropyl-(C7) $PO_1$; 1,3-propanediol, 2-methyl-2-isopropyl-(C7) n-$BO_{23}$; 1,3-propanediol, 2-methyl-2-propyl-(C7) $E_{4-7}$; 1,3-propanediol, 2-methyl-2-propyl-(C7) $PO_1$; 1,3-propanediol, 2-methyl-2-propyl-(C7) n-$BO_2$; 1,3-propanediol, 2-propyl-(C6) (Me $E_{1-4}$); 1,3-propanediol, 2-propyl-(C6) $PO_2$;

2. 1,2-butanediol (C4) (Me $E_{6-8}$); 1,2-butanediol (C4) $PO_{2-3}$; 1,2-butanediol (C4) $BO_1$; 1,2-butanediol, 2,3-dimethyl-(C6) $E_{2-5}$; 1,2-butanediol, 2,3-dimethyl-(C6) n-$BO_1$; 1,2-butanediol, 2-ethyl-(C6) $E_{13}$; 1,2-butanediol, 2-ethyl-(C6) n-$BO_1$; 1,2-butanediol, 2-methyl-(C5) (Me $E_{1-2}$); 1,2-butanediol, 2-methyl-(C5) $PO_1$; 1,2-butanediol, 3,3-dimethyl-(C6) $E_{2-5}$; 1,2-butanediol, 3,3-dimethyl-(C6) n-$BO_1$; 1,2-butanediol, 3-methyl-(C5) (Me $E_{1-2}$); 1,2-butanediol, 3-methyl-(C5) $PO_1$; 1,3-butanediol (C4) 2(Me $E_{5-6}$); 1,3-butanediol (C4) $BO_2$; 1,3-butanediol, 2,2,3-trimethyl-(C7) (Me $E_{1-3}$); 1,3-butanediol, 2,2,3-trimethyl-(C7) $PO_2$; 1,3-butanediol, 2,2-dimethyl-(C6) (Me $E_{6-8}$); 1,3-butanediol, 2,2-dimethyl-(C6) $PO_3$; 1,3-butanediol, 2,3-dimethyl-(C6) (Me $E_{6-8}$); 1,3-butanediol, 2,3-dimethyl-(C6) $PO_3$; 1,3-butanediol, 2-ethyl-(C6) (Me $E_{4-6}$); 1,3-butanediol, 2-ethyl-(C6) $PO_{2-3}$; 1,3-butanediol, 2-ethyl-(C6) $BO_1$; 1,3-butanediol, 2-ethyl--2-methyl-(C7) (Me $E_1$); 1,3-butanediol, 2-ethyl-2-methyl-(C7) $PO_1$; 1,3-butanediol, 2-ethyl-2-methyl-(C7) n-$BO_3$; 1,3-butanediol, 2-ethyl-3-methyl-(C7) (Me $E_1$); 1,3-butanediol, 2-ethyl-3-methyl-(C7) $PO_1$; 1,3-butanediol, 2-ethyl-3-methyl-(C7) n-$BO_3$; 1,3-butanediol, 2-isopropyl-(C7) (Me $E_1$); 1,3-butanediol, 2-isopropyl-(C7) $PO_1$; 1,3-butanediol, 2-isopropyl-(C7) n-$BO_3$; 1,3-butanediol, 2-methyl-(C5) 2(Me $E_{2-3}$); 1,3-butanediol, 2-methyl-(C5) $PO_4$; 1,3-butanediol, 2-propyl-(C7) $E_{6-8}$; 1,3-butanediol, 2-propyl-(C7) $PO_1$; 1,3-butanediol, 2-propyl-(C7) n-$BO_{2-3}$; 1,3-butanediol, 3-methyl-(C5) 2(Me $E_{2-3}$); 1,3-butanediol, 3-methyl-(C5) $PO_4$; 1,4-butanediol (C4) 2(Me $E_{3-4}$); 1,4-butanediol (C4) $PO_{4-5}$; 1,4-butanediol, 2,2,3-trimethyl-(C7) $E_{6-9}$; 1,4-butanediol, 2,2,3-trimethyl-(C7) $PO_1$; 1,4-butanediol, 2,2,3-trimethyl-(C7) n-$BO_{2-3}$; 1,4-butanediol, 2,2-dimethyl-(C6) (Me $E_{3-6}$); 1,4-butanediol, 2,2-dimethyl-(C6) $PO_2$; 1,4-butanediol, 2,2-dimethyl-(C6) $BO_1$; 1,4-butanediol, 2,3-dimethyl-(C6) (Me $E_{3-6}$); 1,4-butanediol, 2,3-dimethyl-(C6)

$PO_2$; 1,4-butanediol, 2,3-dimethyl-(C6) $BO_1$; 1,4-butanediol, 2-ethyl-(C6) (Me $E_{1-4}$); 1,4-butanediol, 2-ethyl-(C6) $PO_2$; 1,4-butanediol, 2-ethyl-2-methyl-(C7) $E_{4-7}$; 1,4-butanediol, 2-ethyl-2-methyl-(C7) $PO_1$; 1,4-butanediol, 2-ethyl-2-methyl-(C7) n-$BO_2$; 1,4-butanediol, 2-ethyl-3-methyl-(C7) $E_{4-7}$; 1,4-butanediol, 2-ethyl-3-methyl-(C7) $PO_1$; 1,4-butanediol, 2-ethyl-3-methyl-(C7) n-$BO_2$; 1,4-butanediol, 2-isopropyl-(C7) $E_{4-7}$; 1,4-butanediol, 2-isopropyl-(C7) $PO_1$; 1,4-butanediol, 2-isopropyl-(C7) n-$BO_2$; 1,4-butanediol, 2-methyl-(C5) (Me $E_{9-10}$); 1,4-butanediol, 2-methyl-(C5) 2(Me $E_1$); 1,4-butanediol, 2-methyl-(C5) $PO_3$; 1,4-butanediol, 2-propyl-(C7) $E_{2-5}$; 1,4-butanediol, 2-propyl-(C7) n-$BO_1$; 1,4-butanediol, 3-ethyl-1-methyl-(C7) $E_{6-8}$; 1,4-butanediol, 3-ethyl-1-methyl-(C7) $PO_1$; 1,4-butanediol, 3-ethyl-1-methyl-(C7) n-$BO_{2-3}$; 2,3-butanediol (C4) (Me $E_{9-10}$); 2,3-butanediol (C4) 2(Me $E_1$); 2,3-butanediol (C4) $PO_{3-4}$; 2,3-butanediol, 2,3-dimethyl-(C6) $E_{7-9}$; 2,3-butanediol, 2,3-dimethyl-(C6) $PO_1$; 2,3-butanediol, 2,3-dimethyl-(C6) $BO_{2-3}$; 2,3-butanediol, 2-methyl-(C5) (Me $E_{2-5}$); 2,3-butanediol, 2-methyl-(C5) $PO_2$; 2,3-butanediol, 2-methyl-(C5) $BO_1$;

3. 1,2-pentanediol (C5) $E_{7-10}$; 1,2-pentanediol, (C5) $PO_1$; 1,2-pentanediol, (C5) n-$BO_3$; 1,2-pentanediol, 2-methyl (C6) $E_{1-3}$; 1,2-pentanediol, 2-methyl (C6) n-$BO_1$; 1,2-pentanediol, 3-methyl (C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2(Me-$E_{1-2}$); 1,3-pentanediol (C5) $PO_{3-4}$; 1,3-pentanediol, 2,2-dimethyl-(C7) (Me-$E_1$); 1,3-pentanediol, 2,2-dimethyl-(C7) $PO_1$; 1,3-pentanediol, 2,2-dimethyl-(C7) n-$BO_3$; 1,3-pentanediol, 2,3-dimethyl-(C7) (Me-$E_1$); 1,3-pentanediol, 2,3-dimethyl-(C7) $PO_1$; 1,3-pentanediol, 2,3-dimethyl-(C7) n-$BO_3$; 1,3-pentanediol, 2,4-dimethyl-(C7) (Me-$E_1$); 1,3-pentanediol, 2,4-dimethyl-(C7) $PO_1$; 1,3-pentanediol, 2,4-dimethyl-(C7) n-$BO_3$; 1,3-pentanediol, 2-ethyl-(C7) $E_{6-8}$; 1,3-pentanediol, 2-ethyl-(C7) $PO_1$; 1,3-pentanediol, 2-ethyl-(C7) n-$BO_{2-3}$; 1,3-pentanediol, 2-methyl-(C6) 2(Me-$E_{4-6}$); 1,3-pentanediol, 2-methyl-(C6) $PO_{2-3}$; 1,3-pentanediol, 3,4-dimethyl-(C7) (Me-$E_1$); 1,3-pentanediol, 3,4-dimethyl-(C7) $PO_1$; 1,3-pentanediol, 3,4-dimethyl-(C7) n-$BO_3$; 1,3-pentanediol, 3-methyl-(C6) 2(Me-$E_{4-6}$); 1,3-pentanediol, 3-methyl-(C6) $PO_{2-3}$; 1,3-pentanediol, 4,4-dimethyl-(C7) (Me-$E_1$); 1,3-pentanediol, 4,4-dimethyl-(C7) $PO_1$; 1,3-pentanediol, 4,4-dimethyl-(C7) n-$BO_3$; 1,3-pentanediol, 4-methyl-(C6) 2(Me-$E_{4-6}$); 1,3-pentanediol, 4-methyl-(C6) $PO_{2-3}$; 1,4-pentanediol, (C5) 2(Me-$E_{1-2}$); 1,4-pentanediol (C5) $PO_{3-4}$; 1,4-pentanediol, 2,2-dimethyl-(C7) (Me-$E_1$); 1,4-pentanediol, 2,2-dimethyl-(C7) $PO_1$; 1,4-pentanediol, 2,2-dimethyl-(C7) n-$BO_3$; 1,4-pentanediol, 2,3-dimethyl-(C7) (Me-$E_1$); 1,4-pentanediol, 2,3-dimethyl-(C7) $PO_1$; 1,4-pentanediol, 2,3-dimethyl-(C7) n-$BO_3$; 1,4-pentanediol, 2,4-dimethyl-(C7) (Me-$E_1$); 1,4-pentanediol, 2,4-dimethyl-(C7) $PO_1$; 1,4-pentanediol, 2,4-dimethyl-(C7) n-$BO_3$; 1,4-pentanediol, 2-methyl-(C6) (Me-$E_{4-6}$); 1,4-pentanediol, 2-methyl-(C6) $PO_{2-3}$; 1,4-pentanediol, 3,3-dimethyl-(C7) (Me-$E_1$); 1,4-pentanediol, 3,3-dimethyl-(C7) $PO_1$; 1,4-pentanediol, 3,3-dimethyl-(C7) n-$BO_3$; 1,4-pentanediol, 3,4-dimethyl-(C7) (Me-$E_1$); 1,4-pentanediol, 3,4-dimethyl-(C7) $PO_1$; 1,4-pentanediol, 3,4-dimethyl-(C7) n-$BO_3$; 1,4-pentanediol, 3-methyl-(C6) 2(Me-$E_{4-6}$); 1,4-pentanediol, 3-methyl-(C6) $PO_{2-3}$; 1,4-pentanediol, 4-methyl-(C6) 2(Me-$E_{4-6}$); 1,4-pentanediol, 4-methyl-(C6) $PO_{2-3}$; 1,5-pentanediol, (C5) (Me-$E_{8-10}$); 1,5-pentanediol (C5) 2(Me-$E_1$); 1,5-pentanediol (C5) $PO_3$; 1,5-pentanediol, 2,2-dimethyl-(C7) $E_{4-7}$; 1,5-pentanediol, 2,2-dimethyl-(C7) $PO_1$; 1,5-pentanediol, 2,2-dimethyl-(C7) n-$BO_2$; 1,5-pentanediol, 2,3-dimethyl-(C7) $E_{4-7}$; 1,5-pentanediol, 2,3-dimethyl-(C7) $PO_1$; 1,5-pentanediol, 2,3-dimethyl-(C7) n-$BO_2$; 1,5-pentanediol, 2,4-dimethyl-(C7) $E_{4-7}$; 1,5-pentanediol, 2,4-dimethyl-(C7) $PO_1$; 1,5-pentanediol, 2,4-dimethyl-(C7) n-$BO_2$; 1,5-pentanediol, 2-ethyl-(C7) $E_{2-5}$; 1,5-pentanediol, 2-ethyl-(C7) n-$BO_1$; 1,5-pentanediol, 2-methyl-(C6) (Me-$E_{1-4}$); 1,5-pentanediol, 2-methyl-(C6) $PO_2$; 1,5-pentanediol, 3,3-dimethyl-(C7) $E_{4-7}$; 1,5-pentanediol, 3,3-dimethyl-(C7) $PO_1$; 1,5-pentanediol, 3,3-dimethyl-(C7) n-$BO_2$; 1,5-pentanediol, 3-methyl-(C6) (Me-$E_{1-4}$); 1,5-pentanediol, 3-methyl-(C6) $PO_2$; 2,3-pentanediol, (C5) (Me-$E_{1-3}$); 2,3-pentanediol, (C5) $PO_2$; 2,3-pentanediol, 2-methyl-(C6) $E_{4-7}$; 2,3-pentanediol, 2-methyl-(C6) $PO_1$; 2,3-pentanediol, 2-methyl-(C6) n-$BO_2$; 2,3-pentanediol, 3-methyl-(C6) $E_{4-7}$; 2,3-pentanediol, 3-methyl-(C6) $PO_1$; 2,3-pentanediol, 3-methyl-(C6) n-$BO_2$; 2,3-pentanediol, 4-methyl-(C6) $E_{4-7}$; 2,3-pentanediol, 4-methyl-(C6) $PO_1$; 2,3-pentanediol, 4-methyl-(C6) n-$BO_2$; 2,4-pentanediol, (C5) 2(Me-$E_{2-4}$); 2,4-pentanediol (C5) $PO_4$; 2,4-pentanediol, 2,3-dimethyl-(C7) (Me-$E_{2-4}$); 2,4-pentanediol, 2,3-dimethyl-(C7) $PO_2$; 2,4-pentanediol, 2,4-dimethyl-(C7) (Me-$E_{2-4}$); 2,4-pentanediol, 2,4-dimethyl-(C7) $PO_2$; 2,4-pentanediol, 2-methyl-(C7) (Me-$E_{8-10}$); 2,4-pentanediol, 2-methyl-(C7) $PO_3$; 2,4-pentanediol, 3,3-dimethyl-(C7) (Me-$E_{2-4}$); 2,4-pentanediol, 3,3-dimethyl-(C7) $PO_2$; 2,4-pentanediol, 3-methyl-(C6) (Me-$E_{8-10}$); 2,4-pentanediol, 3-methyl-(C6) $PO_3$;

4. 1,3-hexanediol (C6) (Me-$E_{2-5}$); 1,3-hexanediol (C6) $PO_2$; 1,3-hexanediol (C6) $BO_1$; 1,3-hexanediol, 2-methyl-(C7) $E_{6-8}$; 1,3-hexanediol, 2-methyl-(C7) $PO_1$; 1,3-hexanediol, 2-methyl-(C7) n-$BO_{2-3}$; 1,3-hexanediol, 3-methyl-(C7) $E_{6-8}$; 1,3-hexanediol, 3-methyl-(C7) $PO_1$; 1,3-hexanediol, 3-methyl-(C7) n-$BO_{2-3}$; 1,3-hexanediol, 4-methyl-(C7) $E_{6-8}$; 1,3-hexanediol, 4-methyl-(C7) $PO_1$; 1,3-hexanediol, 4-methyl-(C7) n-$BO_{2-3}$; 1,3-hexanediol, 5-methyl-(C7) $E_{6-8}$; 1,3-hexanediol, 5-methyl-(C7) $PO_1$; 1,3-hexanediol, 5-methyl-(C7) n-$BO_{2-3}$; 1,4-hexanediol (C6) (Me-$E_{2-5}$); 1,4-hexanediol (C6) $PO_2$; 1,4-hexanediol (C6) $BO_1$; 1,4-hexanediol, 2-methyl-(C7) $E_{6-8}$; 1,4-hexanediol, 2-methyl-(C7) $PO_1$; 1,4-hexanediol, 2-methyl-(C7) n-$BO_{2-3}$; 1,4-hexanediol, 3-methyl-(C7) $E_{6-8}$; 1,4-hexanediol, 3-methyl-(C7) $PO_1$; 1,4-hexanediol, 3-methyl-(C7) n-$BO_{2-3}$; 1,4-hexanediol, 4-methyl-(C7) $E_{6-8}$; 1,4-hexanediol, 4-methyl-(C7) $PO_1$; 1,4-hexanediol, 4-methyl-(C7) n-$BO_{2-3}$; 1,4-hexanediol, 5-methyl-(C7) $E_{6-8}$; 1,4-hexanediol, 5-methyl-(C7) $PO_1$; 1,4-hexanediol, 5-methyl-(C7) n-$BO_{2-3}$; 1,5-hexanediol (C6) (Me-$E_{2-5}$); 1,5-hexanediol (C6) $PO_2$; 1,5-hexanediol (C6) $BO_1$; 1,5-hexanediol, 2-methyl-(C7) $E_{6-8}$; 1,5-hexanediol, 2-methyl-(C7) $PO_1$; 1,5-hexanediol, 2-methyl-(C7) n-$BO_{2-3}$; 1,5-hexanediol, 3-methyl-(C7) $E_{6-8}$; 1,5-hexanediol, 3-methyl-(C7) $PO_1$; 1,5-hexanediol, 3-methyl-(C7) n-$BO_{2-3}$; 1,5-hexanediol, 4-methyl-(C7) $E_{6-8}$; 1,5-hexanediol, 4-methyl-(C7) $PO_1$; 1,5-hexanediol, 4-methyl-(C7) n-$BO_{2-3}$; 1,5-hexanediol, 5-methyl-(C7) $E_{6-8}$; 1,5-hexanediol, 5-methyl-(C7)

$PO_1$; 1,5-hexanediol, 5-methyl-(C7) n-$BO_{2-3}$; 1,6-hexanediol (C6) (Me-$E_{1-2}$); 1,6-hexanediol (C6) $PO_{1-2}$; 1,6-hexanediol (C6) n-$BO_4$; 1,6-hexanediol, 2-methyl-(C7) $E_{2-5}$; 1,6-hexanediol, 2-methyl-(C7) n-$BO_1$; 1,6-hexanediol, 3-methyl-(C7) $E_{2-5}$; 1,6-hexanediol, 3-methyl-(C7) n-$BO_1$; 2,3-hexanediol (C6) $E_{2-5}$; 2,3-hexanediol (C6) n-$BO_1$; 2,4-hexanediol (C6) (Me-$E_{5-8}$); 2,4-hexanediol (C6) $PO_3$; 2,4-hexanediol, 2-methyl-(C7) (Me-$E_{1-2}$); 2,4-hexanediol 2-methyl-(C7) $PO_{1-2}$; 2,4-hexanediol, 3-methyl-(C7) (Me-$E_{1-2}$); 2,4-hexanediol 3-methyl-(C7) $PO_{1-2}$; 2,4-hexanediol, 4-methyl-(C7) (Me-$E_{1-2}$); 2,4-hexanediol 4-methyl-(C7) $PO_{1-2}$; 2,4-hexanediol, 5-methyl-(C7) (Me-$E_{1-2}$); 2,4-hexanediol 5-methyl-(C7) $PO_{1-2}$; 2,5-hexanediol (C6) (Me-$E_{5-8}$); 2,5-hexanediol (C6) $PO_3$; 2,5-hexanediol, 2-methyl-(C7) (Me-$E_{1-2}$); 2,5-hexanediol 2-methyl-(C7) $PO_{1-2}$; 2,5-hexanediol, 3-methyl-(C7) (Me-$E_{1-2}$); 2,5-hexanediol 3-methyl-(C7) $PO_{1-2}$; 3,4-hexanediol (C6) $EO_{2-5}$; 3,4-hexanediol (C6) n-$BO_1$;

5. 1,3-heptanediol (C7) $E_{3-6}$; 1,3-heptanediol (C7) $PO_1$; 1,3-heptanediol (C7) n-$BO_2$; 1,4-heptanediol (C7) $E_{3-6}$; 1,4-heptanediol (C7) $PO_1$; 1,4-heptanediol (C7) n-$BO_2$; 1,5-heptanediol (C7) $E_{3-6}$; 1,5-heptanediol (C7) $PO_1$; 1,5-heptanediol (C7) n-$BO_2$; 1,6-heptanediol (C7) $E_{3-6}$; 1,6-heptanediol (C7) $PO_1$; 1,6-heptanediol (C7) n-$BO_2$; 1,7-heptanediol (C7) $E_{1-2}$; 1,7-heptanediol (C7) n-$BO_1$; 2,4-heptanediol (C7) $E_{7-10}$; 2,4-heptanediol (C7) (Me-$E_1$); 2,4-heptanediol (C7) $PO_1$; 2,4-heptanediol (C7) n-$BO_3$; 2,5-heptanediol (C7) $E_{7-10}$; 2,5-heptanediol (C7) (Me-$E_1$); 2,5-heptanediol (C7) $PO_1$; 2,5-heptanediol (C7) n-$BO_3$; 2,6-heptanediol (C7) $E_{7-10}$; 2,6-heptanediol (C7) (Me-$E_1$); $E_1$); 2,6-heptanediol (C7) $PO_1$; 2,6-heptanediol (C7) n-$BO_3$; 3,5-heptanediol (C7) $E_{7-10}$; 3,5-heptanediol (C7) (Me-$E_1$); 3,5-heptanediol (C7) $PO_1$; 3,5-heptanediol (C7) n-$BO_3$;

6. 1,3-butanediol, 3-methyl-2-isopropyl-(C8) $PO_1$; 2,4-pentanediol, 2,3,3-trimethyl-(C8) $PO_1$; 1,3-butanediol, 2,2-diethyl-(C8) $E_{2-5}$; 2,4-hexanediol, 2,3-dimethyl-(C8) $E_{2-5}$; 2,4-hexanediol, 2,4-dimethyl-(C8) $E_{2-5}$; 2,4-hexanediol, 2,5-dimethyl-(C8) $E_{2-5}$; 2,4-hexanediol, 3,3-dimethyl-(C8) $E_{2-5}$; 2,4-hexanediol, 3,4-dimethyl-(C8) $E_{2-5}$; 2,4-hexanediol, 3,5-dimethyl-(C8) $E_{2-5}$; 2,4-hexanediol, 4,5-dimethyl-(C8) $E_{2-5}$; 2,4-hexanediol, 5,5-dimethyl-(C8) $E_{2-5}$; 2,5-hexanediol, 2,3-dimethyl-(C8) $E_{2-5}$; 2,5-hexanediol, 2,4-dimethyl-(C8) $E_{2-5}$; 2,5-hexanediol, 2,5-dimethyl-(C8) $E_{2-5}$; 2,5-hexanediol, 3,3-dimethyl-(C8) $E_{2-5}$; 2,5-hexanediol, 3,4-dimethyl-(C8) $E_{2-5}$; 3,5-heptanediol, 3-methyl-(C8) $E_{2-5}$; 1,3-butanediol, 2,2-diethyl-(C8) n-$BO_{1-2}$; 2,4-hexanediol, 2,3-dimethyl-(C8) n-$BO_{1-2}$; 2,4-hexanediol, 2,4-dimethyl-(C8) n-$BO_{1-2}$; 2,4-hexanediol, 2,5-dimethyl-(C8) n-$BO_{1-2}$; 2,4-hexanediol, 3,3-dimethyl-(C8) n-$BO_{1-2}$; 2,4-hexanediol, 3,4-dimethyl-(C8) n-$BO_{1-2}$; 2,4-hexanediol, 3,5-dimethyl-(C8) n-$BO_{1-2}$; 2,4-hexanediol, 4,5-dimethyl-(C8) n-$BO_{1-2}$; 2,4-hexanediol, 5,5-dimethyl-, n-$BO_{1-2}$; 2,5-hexanediol, 2,3-dimethyl-(C8) n-$BO_{1-2}$; 2,5-hexanediol, 2,4-dimethyl-(C8) n-$BO_{1-2}$; 2,5-hexanediol, 2,5-dimethyl-(C8) n-$BO_{1-2}$; 2,5-hexanediol, 3,3-dimethyl-(C8) n-$BO_{1-2}$; 2,5-hexanediol, 3,4-dimethyl-(C8) n-$BO_{1-2}$; 3,5-heptanediol, 3-methyl-(C8) n-$BO_{1-2}$; 1,3-propanediol, 2-(1,2-dimethylpropyl)-(C8) n-$BO_1$; 1,3-butanediol, 2-ethyl-2,3-dimethyl-(C8) n-$BO_1$; 1,3-butanediol, 2-methyl-2-isopropyl-(C8) n-$BO_1$; 1,4-butanediol, 3-methyl-2-isopropyl-(C8) n-$BO_1$; 1,3-pentanediol, 2,2,3-trimethyl-(C8) n-$BO_1$; 1,3-pentanediol, 2,2,4-trimethyl-(C8) n-$BO_1$; 1,3-pentanediol, 2,4,4-trimethyl-(C8) n-$BO_1$; 1,3-pentanediol, 3,4,4-trimethyl-(C8) n-$BO_1$; 1,4-pentanediol, 2,2,3-trimethyl-(C8) n-$BO_1$; 1,4-pentanediol, 2,2,4-trimethyl-(C8) n-$BO_1$; 1,4-pentanediol, 2,3,3-trimethyl-(C8) n-$BO_1$; 1,4-pentanediol, 2,3,4-trimethyl-(C8) n-$BO_1$; 1,4-pentanediol, 3,3,4-trimethyl-(C8) n-$BO_1$; 2,4-pentanediol, 2,3,4-trimethyl-(C8) n-$BO_1$; 2,4-hexanediol, 4-ethyl-(C8) n-$BO_1$; 2,4-heptanediol, 2-methyl-(C8) n-$BO_1$; 2,4-heptanediol, 3-methyl-(C8) n-$BO_1$; 2,4-heptanediol, 4-methyl-(C8) n-$BO_1$; 2,4-heptanediol, 5-methyl-(C8) n-$BO_1$; 2,4-heptanediol, 6-methyl-(C8) n-$BO_1$; 2,5-heptanediol, 2-methyl-(C8) n-$BO_1$; 2,5-heptanediol, 3-methyl-(C8) n-$BO_1$; 2,5-heptanediol, 4-methyl-(C8) n-$BO_1$; 2,5-heptanediol, 5-methyl-(C8) n-$BO_1$; 2,5-heptanediol, 6-methyl-(C8) n-$BO_1$; 2,6-heptanediol, 2-methyl-(C8) n-$BO_1$; 2,6-heptanediol, 3-methyl-(C8) n-$BO_1$; 2,6-heptanediol, 4-methyl-(C8) n-$BO_1$; 3,5-heptanediol, 2-methyl-(C8) n-$BO_1$; 1,3-propanediol, 2-(1,2-dimethylpropyl)-(C8) $E_{1-3}$; 1,3-butanediol, 2-ethyl-2,3-dimethyl-(C8) $E_{1-3}$; 1,3-butanediol, 2-methyl-2-isopropyl-(C8) $E_{1-3}$; 1,4-butanediol, 3-methyl-2-isopropyl-(C8) $E_{1-3}$; 1,3-pentanediol, 2,2,3-trimethyl-(C8) $E_{1-3}$; 1,3-pentanediol, 2,2,4-trimethyl-(C8) $E_{1-3}$; 1,3-pentanediol, 2,4,4-trimethyl-(C8) $E_{1-3}$; 1,3-pentanediol, 3,4,4-trimethyl-(C8) $E_{1-3}$; 1,4-pentanediol, 2,2,3-trimethyl-(C8) $E_{1-3}$; 1,4-pentanediol, 2,2,4-trimethyl-(C8) $E_{1-3}$; 1,4-pentanediol, 2,3,3-trimethyl-(C8) $E_{1-3}$; 1,4-pentanediol, 2,3,4-trimethyl-(C8) $E_{1-3}$; 1,4-pentanediol, 3,3,4-trimethyl-(C8) $E_{1-3}$; 2,4-pentanediol, 2,3,4-trimethyl-(C8) $E_{1-3}$; 2,4-hexanediol, 4-ethyl-(C8) $E_{1-3}$; 2,4-heptanediol, 2-methyl-(C8) $E_{1-3}$; 2,4-heptanediol, 3-methyl-(C8) $E_{1-3}$; 2,4-heptanediol, 4-methyl-(C8) $E_{1-3}$; 2,4-heptanediol, 5-methyl-(C8) $E_{1-3}$; 2,4-heptanediol, 6-methyl-(C8) $E_{1-3}$; 2,5-heptanediol, 2-methyl-(C8) $E_{1-3}$; 2,5-heptanediol, 3-methyl-(C8) $E_{1-3}$; 2,5-heptanediol, 4-methyl-(C8) $E_{1-3}$; 2,5-heptanediol, 5-methyl-(C8) $E_{1-3}$; 2,5-heptanediol, 6-methyl-(C8) $E_{1-3}$; 2,6-heptanediol, 2-methyl-(C8) $E_{1-3}$; 2,6-heptanediol, 3-methyl-(C8) $E_{1-3}$; 2,6-heptanediol, 4-methyl-(C8) $E_{1-3}$; and/or 3,5-heptanediol, 2-methyl-(C8) $E_{1-3}$; and 7. mixtures thereof.

Of the nonane isomers, only 2,4-pentadiol, 2,3,3,4-tetramethyl- is highly preferred.

In addition to the aliphatic diol principal solvents, and some of their alkoxylated derivatives, discussed hereinbefore and hereinafter, some specific diol ethers are also found to be suitable principal solvents for the formulation of liquid concentrated, clear fabric softener compositions of the present invention. Similar to the aliphatic diol principal solvents, it is discovered that the suitability of each principal solvent is very selective, depending, e.g., on the number of carbon atoms in the specific diol ether molecules. For example, as given in Table VI, for the glyceryl ether series having the formula $HOCH_2$—CHOH—$CH_2$—O—R, wherein R is from C2 to C8 alkyl, only monopentyl ethers with the formula $HOCH_2$—CHOH—$CH_2$—O—$C_5H_{11}$ (3-pentyloxy-1,2-propanediol), wherein the $C_5H_{11}$ group comprises different pentyl isomers, have ClogP values within the preferred ClogP values of from about 0.25 to about 0.62 and are suitable for the formulation of liquid concentrated, clear fabric softeners of the present invention. It is also found that the cyclohexyl derivative, but not the cyclopentyl derivative, is suitable. Similarly, selectivity is exhibited in the selection of aryl glyceryl ethers. Of the many possible aromatic groups, only a few phenol derivatives are suitable.

The same narrow selectivity is also found for the di(hydroxyalkyl)ethers. It is discovered that bis(2-hydroxybutyl)ether, but not bis(2-hydroxypentyl)ether, is suitable. For the di(cyclic hydroxyalkyl) analogs, the bis(2-hydroxycyclopentyl)ether is suitable, but not the bis(2-hydroxycyclohexyl)ether. Non-limiting examples of synthesis methods for the preparation of some preferred di(hydroxyalkyl)ethers are given hereinafter.

The butyl monoglycerol ether (also named 3-butyloxy-1,2-propanediol) is not well suited to form liquid concentrated, clear fabric softeners of the present invention. However, its polyethoxylated derivatives, preferably from about triethoxylated to about nonaethoxylated, more preferably from pentaethoxylated to octaethoxylated, are suitable principal solvents.

All of the preferred alkyl glyceryl ethers and/or di(hydroxyalkyl)ethers are identified in the said PCT specification and the most preferred are: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; and/or 1,2-propanediol, 3-(butyloxy)-, tributyleneoxylated. Preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-benzyloxy-; 1,3-propanediol, 2-(2-phenylethyloxy)-; and mixtures thereof. The more preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-(2-phenylethyloxy)-; and mixtures thereof. The most preferred di(hydroxyalkyl)ethers include: bis(2-hydroxybutyl)ether; and bis(2-hydroxycyclopentyl)ether;

Non-limiting example of synthesis methods to prepare the preferred alkyl and aryl monoglyceryl ethers are disclosed in the said PCT specification.

The alicyclic diols and their derivatives that are preferred include: (1) the saturated diols and their derivatives including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-Cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; 1,3-cyclooctanediol; 1,4cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate. The most preferred saturated alicyclic diols and their derivatives are: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1-hydroxy-cyclohexanemethanol; 1-methyl-1,2-cyclohexanediol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 1,2-cycloheptanediol; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; and/or 1,2-cyclohexanediol, dibutylenoxylate.

Preferred aromatic diols include: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; and/or 1-phenyl-1,4-butanediol, of which, 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; and/or 1-phenyl-1,4-butanediol are the most preferred.

As discussed hereinafter, all of the unsaturated materials that are related to the other preferred principal solvents herein by the same relationship, i.e., having one more $CH_2$ group than the corresponding saturated principal solvent and remaining within the effective ClogP range are preferred. However, the specific preferred unsaturated diol principal solvents are: 1,3-butanediol, 2,2-diallyl-; 1,3-butanediol, 2-(1-ethyl-1-propenyl)-; 1,3-butanediol, 2-(2-butenyl)-2-methyl-; 1,3-butanediol, 2-(3-methyl-2-butenyl)-; 1,3-butanediol, 2-ethyl-2-(2-propenyl)-; 1,3-butanediol, 2-methyl-2-(1-methyl-2-propenyl)-; 1,4-butanediol, 2,3-bis(1-methylethylidene)-; 1,3-pentanediol, 2-ethenyl-3-ethyl-; 1,3-pentanediol, 2-ethenyl-4,4-dimethyl-; 1,4-pentanediol, 3-methyl-2-(2-propenyl)-; 4-pentene-1,3-diol, 2-(1,1-dimethylethyl)-; 4-pentene-1,3-diol, 2-ethyl-2,3-dimethyl-; 1,4-hexanediol, 4-ethyl-2-methylene-; 1,5-hexadiene-3,4-diol, 2,3,5-trimethyl-; 1,5-hexanediol, 2-(1-methylethenyl)-; 2-hexene-1,5-diol, 4-ethenyl-2,5-dimethyl-; 1,4-heptanediol, 6-methyl-5-methylene-; 2,4-heptadiene-2,6-diol, 4,6-dimethyl-; 2,6-heptadiene-1,4-diol, 2,5,5-trimethyl-; 2-heptene-1,4-diol, 5,6-dimethyl-; 3-heptene-1,5-diol, 4,6-dimethyl-; 5-heptene-1,3-diol, 2,4-dimethyl-; 5-heptene-1,3-diol, 3,6-dimethyl-; 5-heptene-1,4-diol, 2,6-dimethyl-; 5-heptene-1,4-diol, 3,6-dimethyl-; 6-heptene-1,3-diol, 2,2-dimethyl-; 6-heptene-1,4-diol, 5,6-dimethyl-; 6-heptene-1,5-diol, 2,4-dimethyl-; 6-heptene-1,5-diol, 2-ethylidene-6-methyl-; 6-heptene-2,4-diol, 4-(2-propenyl)-; 1-octene-3,6-diol, 3-ethenyl-; 2,4,6-octatriene-1,8-diol, 2,7-dimethyl-; 2,5-octadiene-1,7-diol, 2,6-dimethyl-; 2,5-octadiene-1,7-diol, 3,7-dimethyl-; 2,6-octadiene-1,4-diol, 3,7-dimethyl-(Rosiridol); 2,6-octadiene-1,8-diol, 2-methyl-; 2,7-octadiene-1,4-diol, 3,7-dimethyl-; 2,7-octadiene-1,5-diol, 2,6-dimethyl-; 2,7-octadiene-1,6-diol, 2,6-dimethyl-(8-hydroxylinalool); 2,7-octadiene-1,6-diol, 2,7-dimethyl-; 2-octene-1,7-diol, 2-methyl-6-methylene-; 3,5-octadiene-2,7-diol, 2,7-dimethyl-; 3,5-octanediol, 4-methylene-; 3,7-octadiene-1,6-diol, 2,6-dimethyl-; 4-octene-1,8-diol, 2-methylene-; 6-octene-3,5-diol, 2-methyl-; 6-octene-3,5-diol, 4-methyl-; 7-octene-2,4-diol, 2-methyl-6-methylene-; 7-octene-2,5-diol, 7-methyl-; 7-octene-3,5-diol, 2-methyl-; 1-nonene-3,5-diol; 1-nonene-3,7-diol; 3-nonene-2,5-diol; 4-nonene-2,8-diol; 6,8-nonadiene-1,5-diol; 7-nonene-2,4-diol; 8-nonene-2,4-diol; 8-nonene-2,5-diol; 1,9-decadiene-3,8-diol; and/or 1,9-decadiene4,6-diol.

Said principal alcohol solvent can also preferably be selected from the group consisting of: 2,5-dimethyl-2,5-hexanediol; 2-ethyl-1,3-hexanediol; 2-methyl-2-propyl-1,3-propanediol; 1,2-hexanediol; and mixtures thereof. More preferably said principal alcohol solvent is selected from the group consisting of 2-ethyl-1,3-hexanediol; 2-methyl-2-propyl-1,3-propanediol; 1,2-hexanediol; and mixtures thereof. Even more preferably, said principal alcohol solvent is selected from the groups consisting of 2-ethyl-1,3-hexanediol; 1,2-hexanediol; and mixtures thereof.

When several derivatives of the same diol with different alkyleneoxy groups can be used, e.g., 2-methyl-2,3-butanediol having 3 to 5 ethyleneoxy groups, or 2 propyleneoxy groups, or 1 butyleneoxy group, it is preferred to use the derivative with the lowest number of groups, i.e., in this case, the derivative with one butyleneoxy group. However, when only about one to about four ethyleneoxy groups are needed to provide good formulatability, such derivatives are also preferred.

Unsaturated Diols

It is found surprisingly that there is a clear similarity between the acceptability (formulatability) of a saturated diol and its unsaturated homologs, or analogs, having higher molecular weights. The unsaturated homologs/analogs have the same formulatability as the parent saturated principal solvent with the condition that the unsaturated principal solvents have one additional methylene (viz., $CH_2$) group for each double bond in the chemical formula. In other words, there is an apparent "addition rule" in that for each good saturated principal solvent of this invention, which is suitable for the formulation of clear, concentrated fabric softener compositions, there are suitable unsaturated principal solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated principal solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated principal solvent to the preferred higher molecular weight unsaturated analogs/homologs containing at least one more carbon atom by inserting one double bond for each additional $CH_2$ group, and thus the total number of hydrogen atoms is kept the same as in the parent saturated principal solvent, as long as the ClogP value of the new solvent remains within the effective 0.15–0.64, preferably from about 0.25 to about 0.62, and more preferably from about 0.40 to about 0.60, range. The following are some illustrative examples:

2,2-Dimethyl-6-heptene-1,3-diol (CAS No. 140192-39-8) is a preferred C9-diol principal solvent and can be considered to be derived by appropriately adding a $CH_2$ group and a double bond to either of the following preferred C8-diol principal solvents: 2-methyl-1,3-heptanediol or 2,2-dimethyl-1,3-hexanediol.

2,4-Dimethyl-5-heptene-1,3-diol (CAS No. 123363-69-9) is a preferred C9-diol principal solvent and can be considered to be derived by appropriately adding a $CH_2$ group and a double bond to either of the following preferred C8-diol principal solvents: 2-methyl-1,3-heptanediol or 2,4-dimethyl-1,3-hexanediol.

2-(1-Ethyl-1-propenyl)-1,3-butanediol (CAS No. 116103-35-6) is a preferred C9-diol principal solvent and can be considered to be derived by appropriately adding a $CH_2$ group and a double bond to either of the following preferred C8-diol principal solvents: 2-(1-ethylpropyl)-1,3-propanediol or 2-(1-methylpropyl)-1,3-butanediol.

2-Ethenyl-3-ethyl-1,3-pentanediol (CAS No. 104683-37-6) is a preferred C9-diol principal solvent and can be considered to be derived by appropriately adding a $CH_2$ group and a double bond to either of the following preferred C8-diol principal solvents: 3-ethyl-2-methyl-1,3-pentanediol or 2-ethyl-3-methyl-1,3-pentanediol.

3,6-Dimethyl-5-heptene-1,4-diol (e.g., CAS No. 106777-99-5) is a preferred C9-diol principal solvent and can be considered to be derived by appropriately adding a $CH_2$ group and a double bond to any of the following preferred C8-diol principal solvents: 3-methyl-1,4-heptanediol; 6-methyl-1,4-heptanediol; or 3,5-dimethyl-1,4-hexanediol.

5,6-Dimethyl-6-heptene-1,4-diol (e.g., CAS No. 152344-16-6) is a preferred C9-diol principal solvent and can be considered to be derived by appropriately adding a $CH_2$ group and a double bond to any of the following preferred C8-diol principal solvents: 5-methyl-1,4-heptanediol; 6-methyl-1,4-heptanediol; or 4,5-dimethyl-1,3-hexanediol.

4-Methyl-6-octene-3,5-diol (CAS No. 156414-254) is a preferred C9-diol principal solvent and can be considered to be derived by appropriately adding a $CH_2$ group and a double bond to any of the following preferred C8-diol principal solvents: 3,5-octanediol, 3-methyl-2,4-heptanediol or 4-methyl-3,5-heptanediol.

Rosiridol (CAS No. 101391-01-9) and isorosiridol (CAS No. 149252-15-3) are two isomers of 3,7-dimethyl-2,6-octadiene-1,4-diol, and are preferred C10-diol principal solvents. They can be considered to be derived by appropriately adding two $CH_2$ groups and two double bonds to any of the following preferred C8-diol principal solvents: 2-methyl-1,3-heptanediol; 6-methyl-1,3-heptanediol; 3-methyl-1,4-heptanediol; 6-methyl-1,4-heptanediol; 2,5-dimethyl-1,3-hexanediol; or 3,5-dimethyl-1,4-hexanediol.

8-Hydroxylinalool (CAS No. 103619-06-3, 2,6-dimethyl-2,7-octadiene-1,6-diol) is a preferred C10-diol principal solvent and can be considered to be derived by appropriately adding two $CH_2$ groups and two double bonds to any of the following preferred C8-diol principal solvents: 2-methyl-1,5-heptanediol; 5-methyl1,5-heptanediol; 2-methyl-1,6-heptanediol; 6-methyl-1,6-heptanediol; or 2,4-dimethyl-1,4-hexanediol.

2,7-Dimethyl-3,7-octadiene-2,5-diol (CAS No. 171436-39-8) is a preferred C10-diol principal solvent and can be considered to be derived by appropriately adding two $CH_2$ group and two double bond to any of the following preferred C8-diol principal solvents: 2,5-octanediol; 6-methyl-1,4-heptanediol; 2-methyl-2,4-heptanediol; 6-methyl-2,4-heptanediol; 2-methyl-2,5-heptanediol; 6-methyl-2,5-heptanediol; and 2,5-dimethyl-2,4-hexanediol.

4-Butyl-2-butene-1,4-diol (CAS No. 153943-66-9) is a preferred C8-diol principal solvent and can be considered to be derived by appropriately adding a $CH_2$ group and a double bond to any of the following preferred C7-diol principal solvents: 2-propyl-1,4-butanediol or 2-butyl-1,3-propanediol.

By the same token, there are cases where a higher molecular weight unsaturated homolog which is derived from a poor, inoperable saturated solvent is itself a poor solvent. For example, 3,5-dimethyl-5-hexene-2,4-diol (e.g., CAS No. 160429-40-3) is a poor unsaturated C8 solvent, and can be considered to be derived from the following poor saturated C7 solvents: 3-methyl-2,4-hexanediol; 5-methyl-2,4-hexanediol; or 2,4-dimethyl-1,3-pentanediol; and 2,6-dimethyl-5-heptene-1,2-diol (e.g., CAS No. 141505-71-7) is a poor unsaturated C9 solvent, and can be considered to be derived from the following poor saturated C8 solvents: 2-methyl-1,2-heptanediol; 6-methyl-1,2-heptanediol; or 2,5-dimethyl-1,2-hexanediol.

There is an exception to the above addition rule, in which saturated principal solvents always have unsaturated analogs/homologs with the same degree of acceptability. The exception relates to saturated diol principal solvents having the two hydroxyl groups situated on two adjacent carbon atoms. In some cases, but not always, inserting one, or more, $CH_2$ groups between the two adjacent hydroxyl groups of a poor solvent results in a higher molecular weight unsaturated homolog which is more suitable for the clear, concentrated fabric softener formulation. For example, the preferred unsaturated 6,6-dimethyl1-heptene-3,5-diol (CAS No. 109788-01-4) having no adjacent hydroxyl groups can be considered to be derived from the inoperable 2,2-dimethyl-3,4-hexanediol which has adjacent hydroxyl groups. In this case, it is more reliable to consider that the 6,6-dimethyl-1-heptene-3,5-diol is derived from either 2-methyl-3,5-heptanediol or 5,5-dimethyl-2,4-hexanediol which are both preferred principal solvents and do not have adjacent hydroxyl groups. Conversely, inserting $CH_2$ groups between the adjacent hydroxyl groups of a preferred principal solvent can result in an inoperable higher molecular weight unsaturated diol solvent. For example, the inoperable unsaturated 2,4-dimethyl-5-hexene-2,4-diol (CAS No. 87604-24-8) having no adjacent hydroxyl groups can be considered to be derived from the preferred 2,3-dimethyl-2,3-pentanediol which has adjacent hydroxyl groups. In this case, it is more reliably to derive the inoperable unsaturated 2,4-dimethyl-5-hexene-2,4-diol from either 2-methyl-2,4-hexanediol or 4-methyl-2,4-hexanediol which are both inoperable solvents and do not have adjacent hydroxyl groups. There are also cases where an inoperable unsaturated solvent having no adjacent hydroxyl groups can be considered to be derived from an inoperable solvent which has adjacent hydroxyl groups, such as the pair 4,5-dimethyl-6-hexene-1,3-diol and 3,4-dimethyl-1,2-pentanediol. Therefore, in order to deduce the formulatability of an unsaturated solvent having no adjacent hydroxyl groups, one should start from a low molecular weight saturated homolog also not having adjacent hydroxyl groups. I.e., in general, the relationship is more reliable when the distance/relationship of the two hydroxy groups is maintained. I.e., it is reliable to start from a saturated solvent with adjacent hydroxyl groups to deduce the formulatability of the higher molecular weight unsaturated homologs also having adjacent hydroxyl groups.

It has been discovered that the use of these specific principal alcohol solvents can produce clear, low viscosity, stable fabric softener compositions at surprisingly low principal solvent levels, i.e., less than about 40%, by weight of the composition when the fabric softener actives have the stated IVs and cis/trans ratios. It has also been discovered that the use of the principal alcohol solvents can produce highly concentrated fabric softener compositions, that are stable and can be diluted, e.g. from about 2:1 to about 10:1, to produce compositions with lower levels of fabric softener that are still stable.

The principal solvents are desirably kept to the lowest levels that are feasible in the present compositions for obtaining translucency or clarity. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 5% to about 15%, the softener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At even higher water levels, the softener to principal solvent ratios should also be even higher.

Mixtures of the above principal solvents are particularly preferred, since one of the problems associated with large amounts of solvents is safety.

Mixtures decrease the amount of any one material that is present. Odor and flammability can also be mimimized by use of mixtures, especially when one of the principal solvents is volatile and/or has an odor, which is more likely for low molecular weight materials. Suitable solvents that can be used at levels that would not be sufficient to produce a clear product are 2,2,4-trimethyl-1,3-pentane diol; the ethoxylate, diethoxylate, or triethoxylate derivatives of 2,2,4-trimethyl-1,3-pentane diol; and/or 2-ethyl-1,3-hexanediol. Preferred mixtures are those where the majority of the solvent is one, or more, that have been identified hereinbefore as most preferred. The use of mixtures of solvents is also preferred, especially when one, or more, of the preferred principal solvents are solid at room temperature. In this case, the mixtures can be made fluid, or have lower melting points, thus improving processability of the softener compositions.

It is possible to substitute for part of a principal solvent or a mixture of principal solvents of this invention with a secondary solvent, or a mixture of secondary solvents, which by themselves are not operable as a principal solvent of this invention, as long as an effective amount of the operable principal solvent(s) of this invention is still present in the liquid concentrated, clear fabric softener composition. An effective amount of the principal solvent(s) of this invention is at least greater than about 5%, preferably more than about 7%, more preferably more than about 10% of the composition, when at least about 15% of the softener active is also present. The substitute solvent(s) can be used at any level, but preferably about equal to, or less than, the amount of operable principal solvent, as defined hereinbefore, that is present in the fabric softener composition.

For example, even though 1,2-pentanediol, 1,3-octanediol, and hydroxy pivalyl hydroxy pivalate (hereinafter, HPHP) having the following formula:

$$HO—CH_2—C(CH_3)_2—CH_2—O—CO—C(CH_3)_2—CH_2—OH \quad \text{(CAS \#1115-20-4)}$$

are inoperable solvents according to this invention, mixtures of these solvents with the principal solvent, e.g., with the preferred 1,2-hexanediol principal solvent, wherein the 1,2-hexanediol principal solvent is present at effective levels, also provide liquid concentrated, clear fabric softener compositions.

Some of the secondary solvents that can be used are those listed as inoperable hereinbefore and hereinafter, as well as some parent, non-alkoxylated solvents disclosed in Tables VIIIA–VIIIE in the said PCT specification.

The principal solvent can be used to either make a composition translucent or clear, or can be used to reduce the temperature at which the composition is translucent or clear. Thus the invention also comprises the method of adding the principal solvent, at the previously indicated levels, to a composition that is not translucent, or clear, or which has a temperature where instability occurs that is too high, to make the composition translucent or clear, or, when the composition is clear, e.g., at ambient temperature, or down to a specific temperature, to reduce the temperature at which instability occurs, preferably by at least about 5° C., more preferably by at least about 10° C. The principal advantage of the principal solvent is that it provides the maximum advantage for a given weight of solvent. It is understood that "solvent", as used herein, refers to the effect of the principal solvent and not to its physical form at a given temperature, since some of the principal solvents are solids at ambient temperature.

Alkyl Lactates

Some alkyl lactate esters, e.g., ethyl lactate and isopropyl lactate have ClogP values within the effective range of from about 0.15 to about 0.64, and can form liquid concentrated, clear fabric softener compositions with the fabric softener actives of this invention, but need to be used at a slightly higher level than the more effective diol solvents like 1,2-hexanediol. They can also be used to substitute for part of other principal solvents of this invention to form liquid concentrated, clear fabric softener compositions. This is illustrated in Example I-C.

III. Other Optional Ingredients (A) The compositions can also contain additional fabric softener active, but only in minor amounts, typically from 0% to about 35%, preferably from about 1% to about 20%, more preferably from about 2% to about 10%, said additional fabric softener active being selected from:

(1) softener having the formula:

$$R_{4-m}—N^{(+)}—R^1{}_mA^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2O)_{2-4}H$ where each $R^2$ is a $C_{1-6}$ alkylene group; and $A^-$ is a softener compatible anion, preferably, chloride, bromide, methylsulfate, ethylsulfate, sulfate, and nitrate, more preferably chloride and methyl sulfate;

(2) softener having the formula:

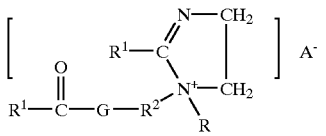

wherein each R, $R^1$, and $A^-$ have the definitions given above; each $R^2$ is a $C_{1-6}$ alkylene group, preferably an ethylene group; and G is an oxygen atom or an -NR- group;

(3) softener having the formula:

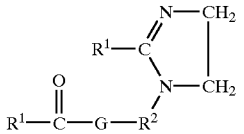

wherein $R^1$, $R^2$ and G are defined as above;

(4) reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—R^3—NH—C(O)—R^1$$

wherein $R^1$, $R^2$ are defined as above, and each $R^3$ is a $C_{1-6}$ alkylene group, preferably an ethylene group;

(5) softener having the formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

(6) the reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above;

(7) softener having the formula:

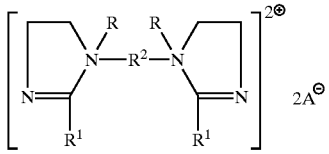

wherein R, $R^1$, $R^2$, and $A^-$ are defined as above; and (8) mixtures thereof.

Other optional but highly desirable cationic compounds which can be used in combination with the above softener actives are compounds containing one long chain acyclic $C_8$–$C_{22}$ hydrocarbon group, selected from the group consisting of:

(8) acyclic quaternary ammonium salts having the formula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above;

(9) substituted imidazolinium salts having the formula:

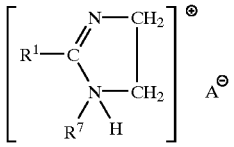

wherein $R^7$ is hydrogen or a $C_1$–$C_4$ saturated alkyl or hydroxyalkyl group, and $R^1$ and $A^-$ are defined as hereinabove;

(10) substituted imidazolinium salts having the formula:

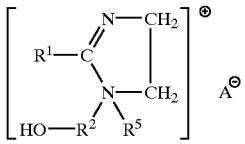

wherein $R^5$ is a $C_1$–$C_4$ alkyl or hydroxyalkyl group, and $R^1$, $R^2$, and $A^-$ are as defined above;

(11) alkylpyridinium salts having the formula:

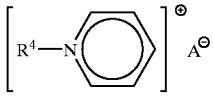

wherein $R^4$ is an acyclic aliphatic $C_8$–$C_{22}$ hydrocarbon group and $A^-$ is an anion; and

(12) alkanamide alkylene pyridinium salts having the formula:

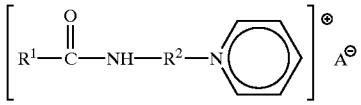

wherein $R^1$, $R^2$ and $A^-$ are defined as herein above; and mixtures thereof.

Examples of Compound (9) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (9) are soyatrimethylammonium chloride available from Witco Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl) oleylammonium chloride wherein $R^1$ is a $C_{18}$ hydrocarbon group, $R^5$ is a 2-hydroxyethyl group and $R^6$ is a methyl group.

(13) Diester Quaternary Ammonium Fabric Softening Active (DEQA)

DEQA preferably comprises (but excluding the essential fabric softener disclosed hereinbefore):

$$[(R)_2—N^+—[(CH_2)_n—Y—R^1]_2]A^-$$

wherein: each R and $A^-$ are as defined hereinbefore in optional softener (1), but R is not hydroxyethyl when n is 2 and y is —O—(O)C—; each n is from 1 to about 4, preferably 2; each Y is —O—(O)C—, —(R)N—(O)C—, —C(O)—N(R)—, or —C(O)—O—, preferably —O(O)C—, but not —OC(O)O—; the sum of carbons in each $R^1$, plus one when Y is —O—(O)C— or —(R)N—(O)C—, is $C_6$–$C_{22}$, preferably $C_{14}$–$C_{20}$, but no more than one $YR^1$ sum being less than about 12 and then the other $YR^1$ sum is at least about 16, with each $R^1$ being a long chain $C_8$–$C_{22}$ (or $C_7$–$C_{21}$)hydrocarbyl, or substituted hydrocarbyl substituent, preferably $C_{10}$–$C_{20}$ (or $C_9$–$C_{19}$) alkyl or alkenyl, most preferably $C_{12}$–$C_{18}$ (or $C_{11}$–$C_{17}$) alkyl or alkenyl, and where, when said sum of carbons is $C_{16}$–$C_{18}$ and $R^1$ is a straight chain alkyl or alkenyl group, the Iodine Value (hereinafter referred to as IV) of the parent fatty acid of this $R^1$ group is preferably from about 20 to about 140, more preferably from about 50 to about 130; and most preferably from about 70 to about 115 [The present invention can also contain medium-chain cationic ammonium fabric softening compound, including DEQA analogs/homologs having the above formula above, wherein:

each C(O)O is replaced by, e.g.: —O—(O)C—, —(R)N—(O)C—, —C(O)—N(R)—, or —C(O)—O—, preferably —O—(O)C—;

m is 2 or 3, preferably 2;

each n is 1 to 4, preferably 2;

each R is as defined hereinbefore;

each $R^1$, or $YR^1$ hydrophobic group is a saturated, $C_8$–$C_{14}$, preferably a $C_{12-14}$ hydrocarbyl, or substituted hydrocarbyl substituent (the IV is preferably about 10 or less, more preferably less than about 5), [The sum of the carbons in the hydrophobic group is the number of carbon atoms in the R group, or in the YR group when Y is —O—(O)C— or —(R)N—(O)C—.] and the counterion, $A^-$, is the same as above. Preferably $A^-$ does not include phosphate salts.

The saturated $C_8$–$C_{14}$ fatty acyl groups can be pure derivatives or can be mixed chainlengths.

Suitable fatty acid sources for said fatty acyl groups are coco, lauric, caprylic, and capric acids.

For $C_{12}$–$C_{14}$ (or $C_{11}$–$C_{13}$) hydrocarbyl groups, the groups are preferably saturated, e.g., the IV is preferably less than about 10, preferably less than about 5.

Another variation has the general formula:

$$R_3—N^+—CH_2—CH(YR)—CH_2—YR^1A^-$$

wherein each Y, R, $R^1$, and $A^-$ have the same meanings as before. Such compounds include those having the formula:

$$[CH_3]_3\ N^{(+)}[CH_2CH(CH_2O(O)CR^1)O(O)CR^1]Cl^{(-)}$$

where each R is a methyl or ethyl group and preferably each $R^1$ is in the range of $C_{15}$ to $C_{19}$. Degrees of branching and substitution can be present in the alkyl or alkenyl chains. The anion $X^{(-)}$ in the molecule is the same as in the essential DEQA above. As used herein, when the diester is specified, it can include the monoester that is present. The amount of monoester that can be present is the same as in DEQA (1).

An example of a preferred DEQA of formula (2) is the "propyl" ester quaternary ammonium fabric softener active having the formula 1,2-di(acyloxy)-3-trimethylammoniopropane chloride, wherein the acyl group is the same as that of $FA^5$.

These types of agents and general methods of making them are disclosed in U.S. Pat. No. 4,137,180, Naik et al., issued Jan. 30, 1979, which is incorporated herein by reference.]; and

(14) Mixtures of any of (1) through (13).

Additional fabric softeners that can be used herein are disclosed, at least generically for the basic structures, in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference. The additional softener actives herein are preferably those that are highly unsaturated versions of the traditional softener actives, i.e., di-long chain alkyl nitrogen derivatives, normally cationic materials, such as dioleyldimethylammonium chloride and imidazolinium compounds as described hereinafter. Examples of more biodegradable fabric softeners can be found in U.S. Pat. No. 3,408,361, Mannheimer, issued Oct. 29, 1968; U. S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; and 4,339,391, Hoffman et al., issued Jul. 13, 1982, said patents being incorporated herein by reference.

Examples of Compound (1) are dialkylenedimethylammonium salts such as dicanoladimethylammonium chloride, dicanoladimethylammonium methylsulfate, di(partially hydrogenated soybean, cis/trans ratio of about 4:1 )dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (2) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft® 3690.

An example of Compound (3) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (4) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (5) is a difatty amidoamine based softener having the formula:

$$R^1—C(O)—NH—CH_2CH_2—N(CH_3)(CH_2CH_2OH)—CH_2CH_2—NH—C(O)—R^1]^+CH_3SO_4^-$$

wherein $R^1$—C(O) is oleoyl group, available commercially from the Witco Corporation under the trade name Varisoft® 222LT.

An example of Compound (6) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$-C(O) is oleoyl group of a commercially available oleic acid derived from a vegetable or animal source, such as Emersol® 223LL or Emersol® 7021, available from Henkel Corporation.

An example of Compound (7) is the diquaternary compound having the formula:

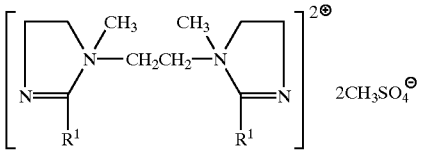

wherein $R^1$ is derived from oleic acid, and the compound is available from Witco Company.

An example of Compound (11) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

(B) Low molecular weight water soluble solvents can also be used at levels of of from 0% to about 12%, preferably from about 1% to about 10%, more preferably from about 2% to about 8%. The water soluble solvents cannot provide a clear product at the same low levels of the principal solvents described hereinbefore but can provide clear product when the principal solvent is not sufficient to provide completely clear product. The presence of these water soluble solvents is therefore highly desirable. Such solvents include: ethanol; isopropanol; 1,2-propanediol; 1,3-propanediol; propylene carbonate; etc. but do not include any of the principal solvents (B). These water soluble solvents have a greater affinity for water in the presence of hydrophobic materials like the softener active than the principal solvents.

(C) Brighteners

The compositions herein can also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

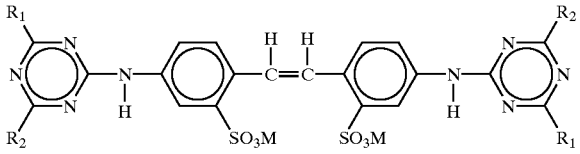

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

(D) Optional Viscosity/Dispersibility Modifiers

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants such as those previously disclosed as optional fabric softeners; (2) nonionic surfactants; (3) amine oxides; (4) fatty acids; and (5) mixtures thereof. These aids are described in P&G Copending application Ser. No. 08/461,207, filed Jun. 5, 1995, Wahl et al., specifically on page 14, line 12 to page 20, line 12, which is herein incorporated by reference.

When said dispersibility aids are present, the total level is from about 2% to about 25%, preferably from about 3% to about 17%, more preferably from about 4% to about 15%, and even more preferably from 5% to about 13% by weight of the composition. These materials can either be added as part of the active softener raw material, (I), e.g., the monolong chain alkyl cationic surfactant and/or the fatty acid which are reactants used to form the biodegradable fabric softener active as discussed hereinbefore, or added as a separate component. The total level of dispersibility aid includes any amount that may be present as part of component (I).

(1) Mono-Alkyl Cationic Quaternary Ammonium Compound

When the mono-long chain alkyl cationic quaternary ammonium compound is present, it is typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

Such mono-alkyl cationic quaternary ammonium compounds useful in the present invention are, preferably, quaternary ammonium salts of the general formula:

$$[R^4N^+(R^5)_3]A^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group;

each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $A^-$ is as defined hereinbefore for (Formula (I)).

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups which can be desirable for increased concentratability of component (I), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$R^1C(O)—O—CH_2CH_2N^+(R)_3\,A^-$$

wherein $R^1$, R and $A^-$ are as defined previously.

Highly preferred dispersibility aids include $C_{12}$–$C_{14}$ coco choline ester and $C_{16}$–$C_{18}$ tallow choline ester.

Suitable biodegradable single-long-chain alkyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis (polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

Suitable mono-long chain materials correspond to the softener actives disclosed above, where only one $R^1$ group is present in the molecule. The $R^1$ group or $YR^1$ group, is replaced normally by an R group.

Although the main function of the dispersibility aid is to increase the dispersibility of the ester softener, preferably the dispersibility aids of the present invention also have some softening properties to boost softening performance of the composition. Therefore, preferably the compositions of the present invention are essentially free of non-nitrogenous ethoxylated nonionic dispersibility aids which will decrease the overall softening performance of the compositions.

Also, quaternary compounds having only a single long alkyl chain, can protect the cationic softener from interacting with anionic surfactants and/or detergent builders that are carried over into the rinse from the wash solution. It is highly desirable to have sufficient single long chain quaternary compound, or cationic polymer to tie up the anionic surfactant. This provides improved wrinkle control. The ratio of fabric softener active to single long chain compound is typically from about 100:1 to about 2:1, preferably from about 50:1 to about 5:1, more preferably from about 13:1 to about 8:1. Under high detergent carry-over conditions, the ratio is preferably from about 5:1 to about 7:1. Typically the single long chain compound is present at a level of about 10 ppm to about 25 ppm in the rinse.

(2) Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecyl-amine oxide, dimethyldodecylamine oxide, dipropyl-tetradecylamine oxide, methylethylhexadecylamine oxide, dimethyl-2-hydroxyoctadecylamine oxide, and coconut fatty alkyl dimethylamine oxide.

(E) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and, preferably, from about 0.01% to about 0.2% for reductive agents. These assure good odor stability under long term storage conditions. Antioxidants and reductive agent stabilizers are especially critical for unscented or low scent products (no or low perfume). These can also, and preferably, be added to the distilled fatty acid and/or before esterification with the triethanolamine, and/or before, or during, the quaternization reaction, and/or post-added to assure good color and odor for the softner active, when it is produced and maintained in storage.

Examples of antioxidants that can be added to the compositions and in the processing of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid. A suitable reductive agent, when used at low levels (e.g., about 50 ppm) is sodium borohydride.

(F) Soil Release Agent

In the present invention, an optional soil release agent can be added. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

Highly preferred soil release agents are polymers of the generic formula:

$$X-(OCH_2CH_2)_p(O-\overset{O}{\overset{\|}{C}}-R^{14}-\overset{O}{\overset{\|}{C}}-OR^{15})_u(O-\overset{O}{\overset{\|}{C}}-R^{14}-O\overset{O}{\overset{\|}{C}}-O)(CH_2CH_2O)_n-X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkenyl moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole, ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof Inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener compositions. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. No. : 4,661,267, Decker, Konig, Straathof, and Gosselink, issued Apr. 28, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,818,569, Trinh, Gosselink, and Rattinger, issued Apr. 4, 1989; U.S. Pat. No. 4,877,896, Maldonado, Trinh, and Gosselink, issued Oct. 31, 1989; U.S. Pat. No. 4,956,447, Gosselink et al., issues Sep. 11, 1990; and U.S. Pat. No. 4,976,879, Maldonado, Trinh, and Gosselink, issued Dec. 11, 1990, all of said patents being incorporated herein by reference.

These soil release agents can also act as scum dispersants.

(G) Scum Dispersant

In the present invention, the premix can be combined with an optional scum dispersant, other than the soil release agent, and heated to a temperature at or above the melting point(s) of the components.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®, Genapol T-800®; Plurafac A-79®; and Neodol 25-500®.

(H) Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon about 1 to about 1,000 ppm by weight of the agent.

(I) Perfume

The present invention can contain any softener compatible perfume. Suitable perfumes are disclosed in U.S. Pat. 5,500,138, Bacon et al., issued Mar. 19, 1996, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenylcarbinyl acetate; Schiff's base of 4-(4-hydroxy-4-methylpentyl)-3-cyclohexene-1-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl)-3-cyclohexene-1-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentylcyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to about 15%, preferably from about 0.1% to about 8%, and more preferably from about 0.2% to about 5%, by weight of the finished composition. Fabric softener compositions of the present invention provide improved fabric perfume deposition.

(J) Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions are improved.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a $CH_2(COOH)CH_2(COOH)$ group.

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. At certain pH's the EDDS is preferably used in combination with zinc cations.

A wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein, in addition to those that are stabilizers. Preferred chelators include DETMP, DETPA, NTA, EDDS and mixtures thereof.

(K) Cationic Polymers

Composition herein can contain from about 0.001% to about 10%, preferably from about 0.01% to about 5%, more preferably from about 0.1% to about 2%, of cationic polymer, typically having a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meq/gm., preferably from about 0.1 to about 8 meq/gm., more preferably from about 0.5 to about 7, and even more preferably from about 2 to about 6. In order to provide the benefits of the cationic polymers, and especially cationic polymers containing amine, or imine, groups, said cationic polymer is preferably primarily in the continuous aqueous phase.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and co-polymers of cationic vinyl pyridine or vinyl pyridinium halides. Preferably the polymers are water soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary, Fourth Edition, J. M. Nikitakis, et al, Editors, published by the Cosmetic, Toiletry, and Fragrance Association, 1991, incorporated herein by reference. The list includes the following:

Of the polysaccharide gums, guar and locust bean gums, which are galactomannam gums are available commercially, and are preferred. Thus guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall). Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

Some very effective individual cationic polymers are the following: Polyvinyl pyridine, molecular weight about 40,000, with about 60% of the available pyridine nitrogens quaternized.; Co-polymer of 70/30 molar proportions of vinyl pyridine/styrene, molecular weight about 43,000, with about 45% of the available pyridine nitrogens quaternized as above; Co-polymers of 60/40 molar proportions of vinyl pyridine/acrylamide, with about 35% of the available pyridine nitrogens quaternized as above. Co-polymers of 77/23 and 57/43 molar proportions of vinyl pyridine/methyl methacrylate, molecular weight about 43,000, with about 97% of the available pyridine nitrogens quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene co-polymer about 0.05%.

Some other effective cationic polymers are: Co-polymer of vinyl pyridine and N-vinyl pyrrolidone (63/37) with about 40% of the available pyridine nitrogens quaternized.; Co-polymer of vinyl pyridine and acrylonitrile (60/40), quaternized as above.; Co-polymer of N,N-dimethyl amino ethyl methacrylate and styrene (55/45) quaternized as above at about 75% of the available amino nitrogens. Eudragit E (Trade Name of Rohm GmbH) quaternized as above at about 75% of the available amino nitrogens. Eudragit E is believed to be co-polymer of N,N-dialkyl amino alkyl methacrylate and a neutral acrylic acid ester, and to have molecular weight about 100,000 to 1,000,000.; Co-polymer of N-vinyl pyrrolidone and N,N-diethyl amino methyl methacrylate (40/50), quaternized at about 50% of the available amino nitrogens.; These cationic polymers can be prepared in a known manner by quaternising the basic polymers.

Yet other cationic polymeric salts are quaternized polyethyleneimines. These have at least 10 repeating units, some or all being quaternized. Commercial examples of polymers of this class are also sold under the generic Trade Name Alcostat by Allied Colloids.

Typical examples of polymers are disclosed in U.S. Pat. No. 4,179,382, incorporated herein by reference.

Each polyamine nitrogen whether primary, secondary or tertiary, is further defined as being a member of one of three general classes; simple substituted, quaternized or oxidized.

The polymers are made neutral by water soluble anions such as chlorine ($Cl^-$), bromine ($Br^-$), iodine ($I^-$) or any other negatively charged radical such as sulfate ($SO_4^{2-}$) and methosulfate ($CH_3SO_3^-$).

Specific polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

An example of modified polyamine cationic polymers of the present invention comprising PEI's comprising a PEI backbone wherein all substitutable nitrogens are modified by replacement of hydrogen with a polyoxyalkyleneoxy unit, $—(CH_2CH_2O)_7H$, has the formula

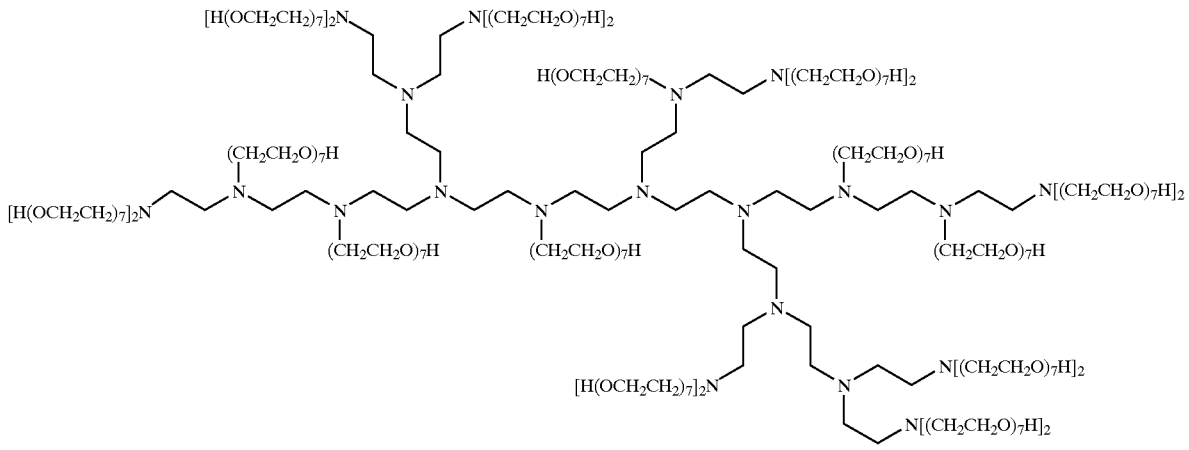

Another suitable polyamine cationic polymer comprises a PEI backbone, as above, wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides.

Yet another related polyamine cationic polymer comprises a PEI backbone wherein all backbone hydrogen atoms are substituted and some backbone amine units are quaternized. The substituents are polyoxyalkyleneoxy units, —$(CH_2CH_2O)_7H$, or methyl groups. Yet still another related polyamine cationic polymer comprises a PEI backbone wherein the backbone nitrogens are modified by substitution (i.e. by —$(CH_2CH_2O)_7H$ or methyl), quaternized, oxidized to N-oxides or combinations thereof.

Of course, mixtures of any of the above described cationic polymers can be employed, and the selection of individual polymers or of particular mixtures can be used to control the physical properties of the compositions such as their viscosity and the stability of the aqueous dispersions.

In order to be most effective, the cationic polymers herein should be, at least to the level disclosed herein, in the continuous aqueous phase. In order to ensure that the polymers are in the continuous aqueous phase, they are preferably added at the very end of the process for making the compositions. The fabric softener actives are normally present in the form of vesicles. After the vesicles have formed, and while the temperature is less than about 85° F., the polymers are added.

(L) Other Optional Ingredients

Silicones

The silicone herein can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt Silicone emulsions can conveniently be used to prepare the compositions of the present invention. However, preferably, the silicone is one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without preemulsification.

Silicone derivatives such as amino-functional silicones, quaternized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the biodegradable cationic fabric softening active on the fabric surface to provide fabric softening effects. However, in a typical laundry process, using an automatic washer, cotton fabric water absorbency is appreciably reduced when there is more than about 40 ppm, especially when there is more than about 50 ppm, of the biodegradable cationic fabric softening active in the rinse water. The silicone improves the fabric water absorbency, especially for freshly treated fabrics, when used with this level of fabric softener without adversely affecting the fabric softening performance. The mechanism by which this improvement in water absorbency occurs is not understood, since the silicones are inherently hydrophobic. It is very surprising that there is any improvement in water absorbency, rather than additional loss of water absorbency.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softener active ratio is from about 2:100 to about 50:100, preferably from about 3:100 to about 35:100, more preferably from about 4:100 to about 25:100. As stated hereinbefore, this typically requires from about 0.2% to about 20%, preferably from about 0.5% to about 10%, more preferably from about 1% to about 5% silicone.

The PDMS also improves the ease of ironing in addition to improving the rewettability characteristics of the fabrics. When the fabric care composition contains an optional soil release polymer, the amount of PDMS deposited on cotton fabrics increases and PDMS improves soil release benefits on polyester fabrics. Also, the PDMS improves the rinsing characteristics of the fabric care compositions by reducing the tendency of the compositions to foam during the rinse. Surprisingly, there is little, if any, reduction in the softening characteristics of the fabric care compositions as a result of the presence of the relatively large amounts of PDMS.

The present invention can include other optional components conventionally used in textile treatment compositions, for example: colorants; preservatives; surfactants; anti-shrinkage agents; fabric crisping agents; spotting agents; germicides; fungicides; anti-oxidants such as butylated hydroxy toluene; anti-corrosion agents; enzymes such as proteases, cellulases, amylases, lipases, etc; and the like.

Particularly preferred ingredients include water soluble calcium and/or magnesium compounds, which provide additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1% to about 0.25%.

The present invention can also include other compatible ingredients, including those as disclosed in copending applications Ser. No.: 08/372,068, filed Jan. 12, 1995, Rusche, et al.; Ser. No. 08/372,490, filed Jan. 12, 1995, Shaw, et al.; and Ser. No. 08/277,558, filed Jul. 19, 1994, Hartman, et al., incorporated herein by reference.

Many synthesis methods can be used to prepare the principal solvents of this invention. Suitable methods are disclosed in the aforesaid copending application, but should not be considered as limiting.

All parts, percentages, proportions, and ratios herein are by weight unless otherwise specified and all numerical values are approximations based upon normal confidence limits. All documents cited are, in relevant part, incorporated herein by reference.

The following non-limiting Examples show clear, or translucent, products with acceptable viscosities.

The synthesis of the fabric softening compound of the present invention is further illustrated in the following Synthesis Examples. These Synthesis Examples are provided for purposes of illustration only.

FATTY ACID COMPOUND SYNTHESIS EXAMPLE A

About 1,300 grams of food grade (refined, bleached, degummed) canola oil and approximately 6.5 grams of a commercial nickel hydrogenation catalyst (Engelhard, "N-545"®) corresponding to approximately 0.13 wt. % Ni, are placed in a hydrogenation reactor which is equipped with stirrer. The reactor is sealed and evacuated. The contents are heated to about 170° C. and hydrogen is fed into the reactor. Stirring at about 450 rpm is maintained throughout the reaction. After about 10 minutes the temperature in the reactor is about 191° C. and the hydrogen pressure is about 11 psig. The temperature is held at about 190° C. After about 127 minutes from when the hydrogen feed began, the hydrogen pressure is about 10 psig. A sample of the reaction mass is drawn and found to have an Iodine Value of about 78 and a cis:trans ratio of about 1.098. After another about 20 minutes at about 190° C., the hydrogen pressure is about 9.8 psig. The hydrogen feed is discontinued and the reactor contents cooled with stirring. The final reaction product has an Iodine Value of about 74.5 and a cis:trans ratio of about 1.35.

The product that forms in the reactor is removed and filtered. It has a cloud point of about 22.2° C. The chain length distributions of the acyl substituents on the sample taken at about 127 minutes, and of the final product, are determined to be as shown in Table 1 in which "sat." means saturated, and "mono" and "di" means monounsaturated and diunsaturated, respectively.

TABLE 1

| | Approximate Percent (mol.) | |
|---|---|---|
| Chain length | Sample @ 127 min. | Product |
| C14-sat. | 0.1 | 0.1 |
| C16-sat. | 4.7 | 4.6 |
| C16-mono. | 0.4 | 0.4 |
| C18-sat. | 8.9 | 13.25 |
| C18-mono. | 77.0 | 73.8 |
| C18-di. | 4.5 | 3.1 |
| C20-sat. | 0.7 | 0.75 |
| C-20-mono. | 2.1 | 2.0 |
| Other | 1.6 | 2.0 |

FATTY ACID COMPOUND SYNTHESIS EXAMPLE B

About 1,300 grams of food grade canola oil and about 5.2 grams of Engelhard "N-545"® nickel hydrogenation catalyst are placed in a hydrogenation reactor which is equipped with a stirrer. The reactor is sealed and evacuated. The contents are heated to about 175° C. and hydrogen is fed into the reactor. Stirring is maintained at about 450 rpm throughout the course of reaction. After about 5 minutes the temperature in the reactor is about 190° C. and the hydrogen pressure is about 7 psig. The temperature is held at about 190° C. After about 125 minutes from the start of the hydrogen feed, the hydrogen pressure is about 7 psig. A sample of the reaction mass is drawn and found to have an Iodine Value of about 85.4. After another about 20 minutes at about 190° C., the hydrogen pressure is about 6 psig. The hydrogen feed is discontinued and the reactor contents cooled with stirring. The final reaction product has an Iodine Value of about 80. The product that forms in the reactor is removed and filtered. It has a cloud point of about 18.6° C.

FATTY ACID COMPOUND SYNTHESIS EXAMPLE C

About 1,300 grams of food grade canola oil and about 2.9 grams of Engelhard "N-545"® nickel hydrogenation catalyst are placed in a hydrogenation reactor which is equipped with a stirrer. The reactor is sealed and evacuated. The contents are heated to about 180° C. and hydrogen is fed into the reactor. Stirring is maintained at about 450 rpm throughout the course of the reaction. After about 5 minutes the temperature in the reactor is about 192° C. and the hydrogen pressure is about 10 psig. The temperature is held at about 190±3° C. After about 105 minutes from the start of the hydrogen feed, the hydrogen pressure is about 10 psig. A sample of the reaction mass is drawn and found to have an Iodine Value of about 85.5. After another about 20 minutes at about 190° C., the hydrogen pressure is about 10 psig. The hydrogen feed is discontinued and the reactor contents cooled with stirring. The final reaction product has an Iodine Value of about 82.4. The product that forms in the reactor is removed and filtered. It has a cloud point of about 17.2° C.

FATTY ACID COMPOUND SYNTHESIS EXAMPLE D

About 1,300 grams of food grade canola oil and about 1.4 grams of Engelhard "N-545"® nickel hydrogenation catalyst are placed in a hydrogenation reactor which is equipped with a stirrer. The reactor is sealed and evacuated. The contents are heated to about 180° C. and hydrogen is fed into the reactor. After about 5 minutes the temperature in the reactor is about 191° C. and the hydrogen pressure is about 10 psig. The temperature is held at about 190±3° C. After about 100 minutes from the start of the hydrogen feed, the hydrogen pressure is about 10 psig. A sample of the reaction mass is drawn and found to have an Iodine Value of about 95.4. After another about 20 minutes at about 190° C., the hydrogen pressure is about 10 psig. The hydrogen feed is discontinued and the reactor contents cooled with stirring. The final reaction product had an Iodine Value of about 2.3. The product that forms in the reactor is removed and filtered. It has a cloud point of about 34° C.

FATTY ACID COMPOUND SYNTHESIS EXAMPLE E

About 1,300 grams of food grade canola oil and about 1.3 grams of Engelhard "N-545"® nickel hydrogenation catalyst are placed in a hydrogenation reactor which is equipped with a stirrer. The reactor is sealed and evacuated. The contents are heated to about 190° C. and hydrogen is fed into the reactor to a hydrogen pressure of about 5 psig. After about 3 hours from the start of the hydrogen feed, a sample of the reaction mass is drawn and found to have an iodine value of about 98. The hydrogenation is interrupted, another about 0.7 grams of the same catalyst is added, and the reaction conditions are reestablished at about 190° C. for another about 1 hour. The hydrogen feed is then discontinued and the reactor contents cooled with stirring. The final reaction product had an Iodine Value of about 89.9. The product that forms in the reactor is removed and filtered. It has a cloud point of about 16° C.

FATTY ACID COMPOUND SYNTHESIS EXAMPLE F

About 1,300 grams of food grade canola oil and about 2.0 grams of Engelhard "N-545"® nickel hydrogenation catalyst are placed in a hydrogenation reactor which is equipped with a stirrer. The reactor is sealed and evacuated. The contents are heated to about 190° C. and hydrogen is fed into the reactor to a hydrogen pressure of about 5 psig. Stirring is maintained at about 420 rpm throughout the course of reaction of the hydrogen feed. After about 130 minutes from the start of the hydrogen feed, the hydrogen feed is discontinued and the reactor contents cooled with stirring. The final reaction product had an Iodine Value of about 96.4. The product that forms in the reactor is removed and filtered. It has a cloud point of about 11.2° C.

FATTY ACID COMPOUND SYNTHESIS EXAMPLE G

A mixture of about 1,200 grams of the hydrogenated oil from Synthesis Example F and about 200 grams of the hydrogenated oil from Synthesis Example A is hydrolyzed three times with about 250° C. steam at about 600 psig for about 2.5 hours at a ratio of steam:oil of about 1.2 (by weight). An aqueous solution containing the glycerine which had split off is removed.

The resulting mixture of fatty acids is vacuum distilled for a total of about 150 minutes, in which the pot temperature rose gradually from about 200° C. to about 238° C. and the head temperature rose gradually from about 175° C. to about 197° C. Vacuum of about 0.3–0.6 mm is maintained.

The fatty acids product of the vacuum distillation has an Iodine Value of about 99.1, an amine value (AV) of about 197.6 and a saponification value (SAP) of about 198.6.

The following are synthesis examples of softener compounds according to the present invention:

Synthesis Example of Softener Compound 1 (SC1)

1)—Esterification

About 489 grams of partly hydrogenated tallow fatty acid with an IV of about 45 and an Acid Value of about 206, commercially available under the tradename Distal 51 and sold by Witco Corporation, is added into the reactor, the reactor is flushed with $N_2$ and about 149 grams of triethanolamine is added under agitation. The molar ratio of fatty acid to triethanol amine is of about 1.8:1. The mixture is heated above about 150° C. and the pressure is reduced to remove the water of condensation. The reaction is prolonged until an Acid Value of about 5 is reached.

2)—Quaternization

To about 627 grams of the product of condensation, about 122 grams of dimethylsulfate is added under continuous agitation. The reaction mixture is kept above about 50° C. and the reaction is followed by verifying the residual amine value. 749 grams of softener compound of the invention is obtained.

The quaternized material is optionally diluted with e.g. about 15% of ethanol which lowers the melting point of the material thereby providing a better handling of the material.

Synthesis Example of Softener Compound 2 (SC2)

1)—Esterification

About 504 grams of oleic fatty acid with an IV of about 90 and an Acid Value of about 198, commercially available under the tradename Emersol 233 and sold by Henkel Corporation, is added into the reactor, the reactor is flushed with $N_2$ and about 149 grams of triethanolamine is added under agitation. The molar ratio of fatty acid to triethanol amine is about 1.8:1. The mixture is heated above about 150° C. and the pressure is reduced to remove the water of condensation. The reaction is prolonged until an Acid Value of about 2 is reached.

2)—Quaternization

To the about 629 grams of the product of condensation, about 122 grams of dimethylsulfate is added under continuous agitation. The reaction mixture is kept above about 50° C. and the reaction is followed by verifying the residual amine value.

About 751 grams of softener compound of the invention is obtained.

The quaternized material is optionally diluted with e.g. about 8% of ethanol which lower the melting point of the material thereby providing a better ease in the handling of the material.

Synthesis Example of Softener Compound 3 (SC3)

1)—Esterification

About 571 grams of Canola fatty acid with an IV of about 100 and an Acid Value of about 196 as made according to Fatty Acid Compound Synthesis Example G is added into the reactor, the reactor is flushed with $N_2$ and about 149 grams of triethanolamine is added under agitation. The molar ratio of fatty acid to triethanol amine is of about 2.0:1. The mixture is heated above about 150° C. and the pressure is reduced to remove the water of condensation. The reaction is prolonged until an Acid Value of about 3 is reached.

2)—Quaternization

To the about 698 grammes of the product of condensation, about 122 grams of dimethylsulfate is added under continuous agitation. The reaction mixture is kept above about 50° C. and the reaction is followed by verifying the residual amine value.

About 820 grams of softener compound of the invention is obtained.

The quaternized material is optionally diluted with e.g. about 15% of an approximately 50:50 ethanol/ hexyleneglycol mixture which lowers the melting point of the material thereby providing a better ease in the handling of the material.

Synthesis Example of Softener Compound 4 (SC4)

1)—Esterification

About 457 grams of Canola fatty acid with an IV of about 100 and an Acid Value of about 196, as made according to Fatty Acid Compound Synthesis Example G, is added into the reactor, the reactor is flushed with N2 and about 149 grams of triethanolamine is added under agitation. The molar ratio of fatty acid to triethanol amine is about 1.6:1. The mixture is heated above about 150° C. and the pressure is reduced to remove the water of condensation. The reaction is prolonged until an Acid Value of about 1 is reached.

2)—Quaternization

To the about 582 grams of the product of condensation, about 122 grams of dimethylsulfate is added under continuous agitation. The reaction mixture is kept above about 50° C. and the reaction is followed by verifying the residual amine value.

704 grams of softener compound of the invention is obtained.

The quaternized material is optionally diluted with e.g. about 8% of ethanol which lower the melting point of the material thereby providing a better ease in the handling of the material.

The above synthesized softener compounds have a Hunter L transmission of about 90 and the following levels of odorants in <g/L:Isopropyl acetate <about 1, typically non-detectable; 1,3,5-trioxane about 5.3; 2,2'-ethylidenebis (oxy)-bispropane <about 1, typically non-detectable; C8 methyl ester <about 1, typically non-detectable; C8 Methyl ester <about 1, typically non-detectable; and C10 Methyl ester <about 1, typically non-detectable.

The above synthesized softener compound are also exemplified below in the non-limiting fabric softening composition examples.

Abbreviations Used in the Examples

In the softening compositions, the abbreviated component identification have the following meanings:

| | |
|---|---|
| SC1 | : Softener compound as made according to Synthesis Example of softener compound 1 |
| SC2 | : Softener compound as made according to Synthesis Example of softener compound 2 |
| SC3 | : Softener compound as made according to Synthesis Example of softener compound 3 |
| SC4 | : Softener compound as made according to Synthesis Example of softener compound 4 |
| TMPD | : 2,2,4-trimethyl-1,3-pentanediol |
| CHDM | : 1,4 cyclohexanedimethanol |

The compositions in the Examples below are made by first preparing an oil seat of softener active at ambient temperature. The softener active can be heated, if necessary, to melting if the softener active is not fluid at room temperature. The softener active is mixed using an IKA RW 25® mixer for about 2 to about 5 minutes at about 150 rpm. Separately, an acid/water seat is prepared by mixing the HCl with deionized (DI) water at ambient temperature. If the softener active and/or the principal solvent(s) are not fluid at room temperature and need to be heated, the acid/water seat should also be heated to a suitable temperature, e.g., about 100° F. (about 38° C.) and maintaining said temperature with a water bath. The principal solvent(s) (melted at suitable temperatures if their melting points are above room temperature) are added to the softener premix and said premix is mixed for about 5 minutes. The acid/water seat is then added to the softener premix and mixed for about 20 to about 30 minutes or until the composition is clear and homogeneous. The composition is allowed to air cool to ambient temperature.

| | 1 | 2 | 3 | 4 | 5 |
|---|---|---|---|---|---|
| SC1 | 8.0 | — | — | — | — |
| SC2 | — | 8.0 | 20 | 30 | 28 |
| Ethanol | 1.4 | 0.7 | 1.7 | 2.6 | 2.4 |
| 1,2 Hexanediol | — | 10 | 15 | — | — |
| 2-ethyl-1,3-hexanediol | — | — | — | — | 12 |
| TMPD | — | — | — | 12 | — |
| CHDM | — | — | — | 5 | 5 |
| HCl | 0.02 | 0.02 | 0.02 | 0.02 | 0.02 |
| Calcium chloride | 0.04 | — | — | — | — |
| Perfume | 0.5 | 0.5 | 1.0 | 2.0 | 2.0 |
| Dye | 5 ppm | 5 ppm | 5 ppm | 5 ppm | 5 ppm |
| Demineralized water | Balance | Balance | Balance | Balance | Balance |

| | 6 | 7 | 8 | 9 |
|---|---|---|---|---|
| SC3 | 8.0 | 25 | — | 28 |
| SC4 | — | — | 30 | — |
| Ethanol | 0.7 | 2.2 | 2.6 | 2.5 |
| Hexylene glycol | 0.7 | 2.2 | — | 2.5 |
| 1,2 Hexanediol | 9 | 12 | 15 | 5 |
| TMPD | — | 5 | — | 9 |
| HCl | 0.02 | 0.02 | 0.02 | 0.02 |
| Perfume | 0.5 | 1.5 | 1.0 | 2.0 |
| Dye | 5 ppm | 20 ppm | 20 ppm | 5 ppm |
| Demin. water | Balance | Balance | Balance | Balance |

The dispersion compositions in the Examples below are made by first preparing an oil seat of softener active at ambient temperature. The softener active can be heated, if necessary, to melting if the softener active is not fluid at room temperature. The softener active is mixed using an IKA RW 25® mixer for about 2 to about 5 minutes at about 150 rpm. Separately, an acid/water seat is prepared by mixing the HCl with deionized (DI) water at ambient temperature. If the softener active is not fluid at room temperature and needs to be heated, the acid/water seat should also be heated to a suitable temperature, e.g., about 100° F. (about 38° C.) and said temperature is maintained with a water bath. The softener is added with high energy mixing to form a stable dispersion.

For commercial purposes, the above compositions 1–9 are introduced into containers, specifically bottles, and more specifically clear bottles (although translucent bottles can be used), made from polypropylene (although glass, oriented polyethylene, etc., can be substituted), the bottle having a light blue tint to compensate for any yellow color that is present, or that may develop during storage (although, for short times, and perfectly clear products, clear containers with no tint, or other tints, can be used), and having an ultraviolet light absorber in the bottle to minimize the effects of ultraviolet light on the materials inside, especially the highly unsaturated actives (the absorbers can also be on the surface). The overall effect of the clarity and the container being to demonstrate the clarity of the compositions, thus assuring the consumer of the quality of the product. The clarity and odor of the fabric softener are critical to acceptance, especially when higher levels of the fabric softener are present.

EXAMPLE 10

| Component | A Wt. % | B Wt. % | C Wt. % | D Wt. % |
|---|---|---|---|---|
| SC3 | 18 | — | — | — |
| SC2 | — | 20 | — | — |
| SC3 | — | — | 20 | — |
| SC4 | — | — | — | 16 |
| Ethanol | 6 | 6 | 6 | 6 |
| $CaCl_2$ | 0.5 | 0.5 | 0.5 | 0.5 |
| HCl | (a) | (a) | (a) | (a) |
| Perfume | 0.2 | 0.2 | 0.2 | 0.2 |
| Kathon | 3 ppm | 3 ppm | 3 ppm | 3 ppm |
| DI Water | Bal. | Bal. | Bal. | Bal. |

(a) To adjust pH of the Composition to about 3.5–4.0.

(a) To adjust pH of the Composition to about 3.54.0.

A softener sample from oleic acid was compared for color verses samples made from canola fatty acid made by methods of this invention. The Hunter "L" value was measured and visual color clarity determined:

| Softener Active | Hunter "L" Value | Acceptable for Clear Compositions |
|---|---|---|
| Varisoft WE-15 (oleic based) | 77.0 | No |
| Softener Active #1 (canola based) | 99.0 | Yes |
| Softener Active #2 (canola based) | 97.9 | Yes |

What is claimed is:

1. Fabric softening compounds having the formula:

$$[RC(O)OC_2H_4]_nN^+(R^1)_mX^-$$

wherein each R in a compound is a $C_6$–$C_{22}$ hydrocarbyl group having a cis:trans isomer ratio above 3:1 and below about 20:1 based upon the equivalent fatty acid, n is a number from 1 to three on the weight average in any mixture of compounds, each $R^1$ in a compound is a $C_{1-3}$ alkyl or hydroxy alkyl group, the total of n and the number of $R^1$ groups that are hydroxyethyl groups equaling 3, n+m equaling 4, and X is a softener compatible anion, the compound having (a) a Hunter L transmission of at least about 85; (b) only very low, non-detectable levels, at the conditions of use, of odorous compounds selected from the group consisting of: isopropyl acetate; 2,2'-ethylidenebis(oxy) bispropane; 1,3,5-trioxane; and/or short chain fatty acid esters having 4–12 carbon atoms; or (c) both.

2. The compound of claim 1 wherein said R has an Iodine Value of from about 70 to about 140 based upon the IV of the equivalent fatty acid.

3. The compound of claim 1 wherein said X is methyl sulfate.

4. The compound of claim 1 wherein said Hunter L transmission is from about 85 to about 95.

5. The compound of claim 4 wherein said Hunter L transmission is from about 90 to about 95.

6. The compound of claim 5 wherein said Hunter L transmission is above about 95.

7. The compound of claim 1 wherein said short chain fatty acid esters contain 6–10 carbon atoms.

8. The compound of claim 1 wherein the level of each odorous compound is as follows: isopropyl acetate is less than about 5 nanograms per liter; 2,2'-ethylidenebis(oxy) bispropane is less than about 200 nanograms per liter; 1,3,5-trioxane is less than about 50 nanograms per liter; and/or each $C_{4-12}$ chain fatty acid ester is less than about 4 nanograms per liter.

9. The compound of claim 8 wherein the level of each odorous compound is as follows: isopropyl acetate is less than about 3 nanograms per liter; 2,2'-ethylidenebis(oxy) bispropane is less than about 100 nanograms per liter; 1,3,5-trioxane is less than about 20 nanograms per liter; and/or each $C_{4-12}$ chain fatty acid ester is less than about 3 nanograms per liter.

10. The compound of claim 9 wherein the level of each odorous compound is as follows: isopropyl acetate is less than about 2 nanograms per liter; 2,2'-ethylidenebis(oxy) bispropane is less than about 10 nanograms per liter; 1,3,5-trioxane is less than about 10 nanograms per liter; and/or each $C_{4-12}$ chain fatty acid ester is less than about 2 nanograms per liter.

11. The composition of claim 9 optionally containing:

(1) an effective amount, sufficient to improve clarity, of low molecular weight water soluble solvent, said water soluble solvent being at a level that will not form clear compositions when used alone;

(2) from about 0.1% to about 8% of perfume;

(3) from about 0.01% to about 0.2% of stabilizer; and (4) an effective amount to improve clarity, of water soluble calcium and/or magnesium salt.

12. Aqueous, stable fabric softener dispersion composition containing: from about 5% to about 35% of the fabric softener compound of claim 1.

13. The composition of claim 12 containing from about 8% to about 30% of the fabric softener compound of claim 1.

14. The composition of claim 13 containing from about 10% to about 28% of the fabric softener compound of claim 1.

15. The composition of claim 14 containing from about 13% to about 26% of the fabric softener compound of claim 1.

16. Clear concentrated fabric conditioning compositions comprising:

A. from about 2% to about 75% of a fabric softening compound or mixtures of such compounds having the formula:

$$[RC(O)OC_2H_4]_nN^+(R^1)_mX^-$$

wherein each R in a compound is a $C_6$–$C_{22}$ hydrocarbyl group having a cis:trans isomer ratio at least about 1:1 and below about 20:1 based upon the equivalent fatty acid, n is a number from 1 to three on the weight average in any mixture of compounds, each $R^1$ in a compound is a $C_{1-3}$ alkyl or hydroxy alkyl group, the total of n and the number of $R^1$ groups that are hydroxyethyl groups equaling 3, n+m equaling 4, and X is a softener compatible anion, the compound having (a) a Hunter L transmission of at least about 85; (b) only very low, non-detectable levels, at the conditions of use, of odorous compounds selected from the group consisting of: isopropyl acetate; 2,2'-ethylidenebis (oxy)bispropane; 1,3,5-trioxane; and/or short chain fatty acid esters having 4–12 carbon atoms; or (c) both;

B. more than 0% and less than about 40% by weight of the composition of principal solvent having a ClogP of from about 0.15 to about 0.64, and at least some degree of asymmetry; and C. water.

17. The composition of claim 16, wherein said Hunter L transmission is from about 85 to about 95.

18. The composition of claim 17, wherein said Hunter L transmission is from about 90 to about 95.

19. The composition of claim 18, wherein said Hunter L transmission is above about 95.

20. The composition of claim 16, wherein said short chain fatty acid esters contain 6–10 carbon atoms.

21. The composition of claim 16, wherein the level of each odorous compound is as follows: isopropyl acetate is less than about 5 nanograms per liter; 2,2'-ethylidenebis (oxy)bispropane is less than about 200 nanograms per liter; 1,3,5-trioxane is less than about 50 nanograms per liter; and/or each $C_{4-12}$ chain fatty acid ester is less than about 4 nanograms per liter.

22. The composition of claim 21, wherein the level of each odorous compound is as follows: isopropyl acetate is less than about 3 nanograms per liter; 2,2'-ethylidenebis (oxy)bispropane is less than about 100 nanograms per liter; 1,3,5-trioxane is less than about 20 nanograms per liter; and/or each $C_{4-12}$ chain fatty acid ester is less than about 3 nanograms per liter.

23. The composition of claim 22, wherein the level of each odorous compound is as follows: isopropyl acetate is less than about 2 nanograms per liter; 2,2'-ethylidenebis (oxy)bispropane is less than about 10 nanograms per liter; 1,3,5-trioxane is less than about 10 nanograms per liter; and/or each $C_{4-12}$ chain fatty acid ester is less than about 2 nanograms per liter.

24. The composition of claim 16 wherein said component A is at a level of from about 8% to about 70%; said component B is at a level of from about 5% to about 40%; and there is from about 3% to about 95% water.

25. The composition of claim 24 wherein said component A is at a level of from about 13% to about 65%; said component B is at a level of from about 7% to about 35%; and there is from about 10% to about 80% water.

26. The composition of claim 25 wherein said component A is at a level of from about 18% to about 40%; said component B is at a level of from about 10% to about 25%; and there is from about 30% to about 70% water.

* * * * *